US007216863B2

(12) United States Patent
Kuwata et al.

(10) Patent No.: US 7,216,863 B2
(45) Date of Patent: May 15, 2007

(54) SHEET PROCESSING APPARATUS ABOVE IMAGE FORMING MEANS AND IMAGE FORMING APPARATUS

(75) Inventors: Takashi Kuwata, Shizuoka-Ken (JP); Yasuyoshi Hayakawa, Shizuoka-Ken (JP); Kaoru Sato, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 82 days.

(21) Appl. No.: 10/420,732

(22) Filed: Apr. 23, 2003

(65) Prior Publication Data

US 2003/0178761 A1 Sep. 25, 2003

Related U.S. Application Data

(62) Division of application No. 09/791,775, filed on Feb. 26, 2001, now Pat. No. 6,581,922.

(30) Foreign Application Priority Data

Jun. 20, 2000 (JP) ..... 2000-185414
Feb. 15, 2001 (JP) ..... 2001-038272

(51) Int. Cl.
*G03G 15/00* (2006.01)

(52) U.S. Cl. ..... 270/58.11; 270/58.08; 270/58.118; 270/58.16

(58) Field of Classification Search ..... 270/58.08, 270/58.11, 58.07, 58.14, 58.16, 58.18; 399/410; 271/243, 244, 245, 146, 221
See application file for complete search history.

(56) References Cited

U.S. PATENT DOCUMENTS 3,719,266 A 3/1973 Korn et al. ..... 198/35
4,473,425 A 9/1984 Baughman et al. ..... 156/356
4,611,741 A * 9/1986 Wilson ..... 227/99
4,893,152 A 1/1990 Ishiguro et al. ..... 355/323
5,044,625 A * 9/1991 Reid ..... 271/293
5,091,754 A 2/1992 Abe et al. ..... 355/317
5,155,537 A 10/1992 Komatsu et al. ..... 355/309
5,172,138 A 12/1992 Okazawa et al. ..... 346/134
5,348,284 A 9/1994 Ishihama et al. ..... 271/160
5,481,336 A 1/1996 Tachibana et al. ..... 355/207
5,593,153 A * 1/1997 Coombs ..... 271/287
5,735,515 A * 4/1998 Hayashi et al. ..... 270/58.11
5,806,842 A * 9/1998 Steinhilber et al. ..... 270/58.08
5,918,101 A * 6/1999 Kuroyanagi ..... 399/407

(Continued)

FOREIGN PATENT DOCUMENTS

EP 0 346 851 12/1989
EP 1 149 792 A2 10/2001
EP 1151949 A1 * 11/2001
GB 1 576 947 10/1980
JP 08225227 A * 9/1996

*Primary Examiner*—Patrick Mackey
*Assistant Examiner*—Matthew J. Kohner
(74) *Attorney, Agent, or Firm*—Fitzpatrick, Cella, Harper & Scinto

(57) ABSTRACT

A sheet processing apparatus, which is configured in a simple construction and at low cost, includes a first sheet stacking portion for temporarily stacking a sheet discharged thereon, an alignment member for aligning the sheet discharged on the first sheet stacking portion, a sheet processing member for performing a predetermined process on the sheet stacked on the first sheet stacking portion, and a second sheet stacking portion located substantially vertically below the first sheet stacking portion. The alignment member acts to cause the aligned sheet to drop to the second sheet stacking portion.

27 Claims, 15 Drawing Sheets

U.S. PATENT DOCUMENTS 6,098,975 A 8/2000 Kobayashi ..... 270/58.09
6,126,163 A 10/2000 Katsuta et al. ..... 271/223
6,206,369 B1 3/2001 Hoshii et al. ..... 271/290
6,231,039 B1 5/2001 Chung ..... 270/58.01
6,260,838 B1 * 7/2001 Coombs ..... 270/58.12
6,328,299 B1 * 12/2001 Coombs ..... 270/58.08
6,330,999 B2 12/2001 Coombs et al. ..... 270/58.18
6,349,934 B1 * 2/2002 Ishiguro et al. ..... 271/218
6,382,615 B1 * 5/2002 Ishiguro et al. ..... 270/58.12
6,450,492 B1 * 9/2002 Coombs et al. ..... 270/58.08
6,450,934 B1 * 9/2002 Coombs ..... 493/383
6,581,922 B2 * 6/2003 Kuwata et al. ..... 270/58.11
6,685,180 B2 * 2/2004 Saegusa et al. ..... 270/58.08
6,705,603 B1 * 3/2004 Kirino et al. ..... 270/12
6,722,646 B2 * 4/2004 Sekiyama et al. ..... 270/58.09
6,814,350 B2 * 11/2004 Saegusa et al. ..... 270/58.14

* cited by examiner

SHEET PROCESSING APPARATUS ABOVE IMAGE FORMING MEANS AND IMAGE FORMING APPARATUS

This is a divisional of U.S. patent application Ser. No. 09/791,775, filed Feb. 26, 2001now U.S. Pat. No. 6,581,922, and allowed on Jan. 28, 2003.

BACKGROUND OF THE INVENTION

1. Field of the Invention

The present invention relates to a sheet processing method of performing a predetermined process on sheets, a sheet processing apparatus for implementing the sheet processing method, and an image forming apparatus having the sheet processing apparatus.

2. Description of Related Art

Heretofore, some image forming apparatuses, such as printers, are provided with a sheet processing apparatus for aligning a plurality of sheets having images formed (printed) thereon and, then, performing a process on the sheets, such as stapling (driving needles into) the end parts of the sheets.

Such a sheet processing apparatus is, in many cases, provided as an option unit which is detachably attached to a printer or a copying machine, and is mounted in such a way as to be connected directly with a sheet discharge port of the body of the image forming apparatus. Then, sheets which have been subjected to printing at the image forming apparatus body are sequentially supplied from the sheet discharge port to the sheet processing apparatus, at which the sheets are aligned and are, then, subjected to a predetermined process.

However, in such a conventional image forming apparatus, there are such inconveniences that, in order to discharge and stack, in the order of page numbers, the sheets subjected to printing at the image forming apparatus body, it is necessary to provide the sheet processing apparatus with an inverting mechanism for inverting sheets, or it is necessary to assure a wide interval between the sheets so as to allow an inverting action on the sheets.

Further, since the sheet processing apparatus is disposed at the side of the sheet discharge port of the image forming apparatus body, not only the area of installation of the whole image forming apparatus is caused to increase, but also the production cost of the image forming apparatus is caused to rise disadvantageously.

BRIEF SUMMARY OF THE INVENTION

The invention has been made in view of the problems mentioned above, and, in accordance with an aspect of the invention, there is provided a sheet processing apparatus, which comprises a first sheet stacking portion for temporarily stacking a sheet discharged thereon, alignment means for aligning the sheet discharged on the first sheet stacking portion, sheet processing means for performing a predetermined process on the sheet stacked on the first sheet stacking portion, and a second sheet stacking portion located substantially vertically below the first sheet stacking portion, wherein the alignment means acts to cause the aligned sheet to drop to the second sheet stacking portion.

The above and further aspects and features of the invention will become apparent from the following detailed description of preferred embodiments thereof taken in conjunction with the accompanying drawings.

DETAILED DESCRIPTION OF THE INVENTION

Hereinafter, preferred embodiments of the invention will be described in detail with reference to the drawings. In the following description, as an embodiment of the invention, there is employed a sheet processing apparatus that is mountable on a printer apparatus, which is represented by a laser beam printer.

Figure 1:
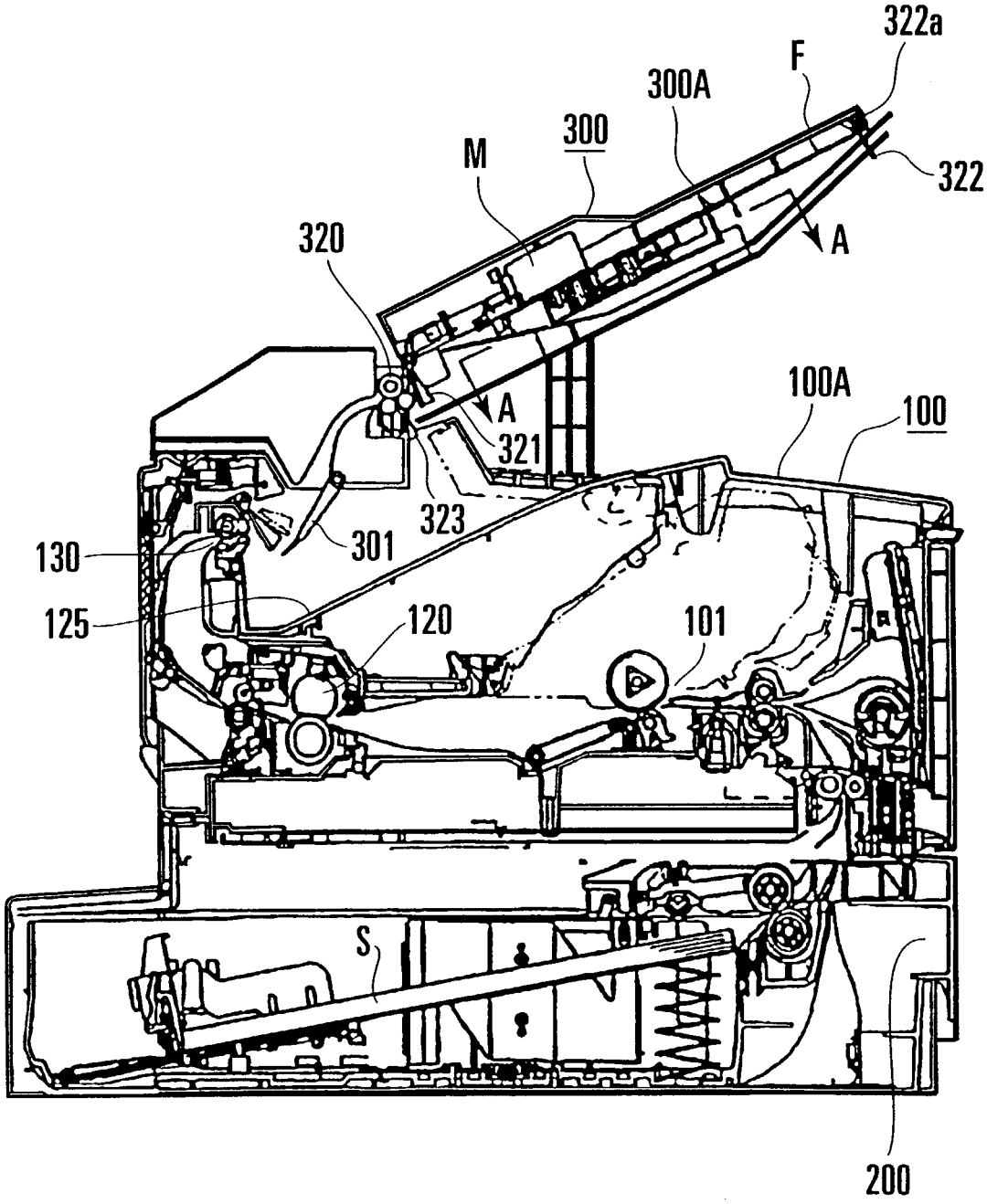
FIG. 1 is a sectional view showing in outline the arrangement of an image forming apparatus having a sheet processing apparatus mounted thereon according to an embodiment of the invention.

First, the outlines of the invention will be described with reference to FIG. 1 to FIGS. 5(*a*) and 5(*b*). FIG. 1 is a sectional view showing in outline the whole arrangement of a sheet processing apparatus and an image processing apparatus (printer) according to the embodiment of the invention.

In FIG. 1, reference numeral 100 denotes a printer body serving as the image forming apparatus. When connected solely to a computer or when connected to a network, the printer body 100 is arranged to form an image (print) on a sheet by a predetermined image forming process on the basis of image information, a printing signal or the like received from the computer or the network.

On the other hand, the sheet processing apparatus, which is denoted by reference numeral 300, is arranged to scoop up, with a flapper 301, a sheet discharged outside from the printer body 100, onto the side of the sheet processing apparatus 300. The sheet is caused to pass through a conveying part provided inside the sheet processing apparatus 300 and is stacked on a first sheet stacking portion in a state in which a surface having an image formed thereon faces downward, i.e., in the so-called face-down state. Then, the sheets as stacked are aligned by an alignment means and are bundled for every predetermined job. The sheets as bundled are subjected to a predetermined process by a sheet processing means. The detailed description of the sheet processing apparatus 300 will be made later herein.

The sheet processing apparatus 300 and the printer body 100 are electrically connected with each other by a cable connector (not shown).

Further, the sheet processing apparatus 300 is provided with a casing part 300A, which contains the various members of the sheet processing apparatus 300. The casing part 300A of the sheet processing apparatus 300 is detachably attached to a casing part 100A of the printer body 100, which will be described later.

Figure 14:
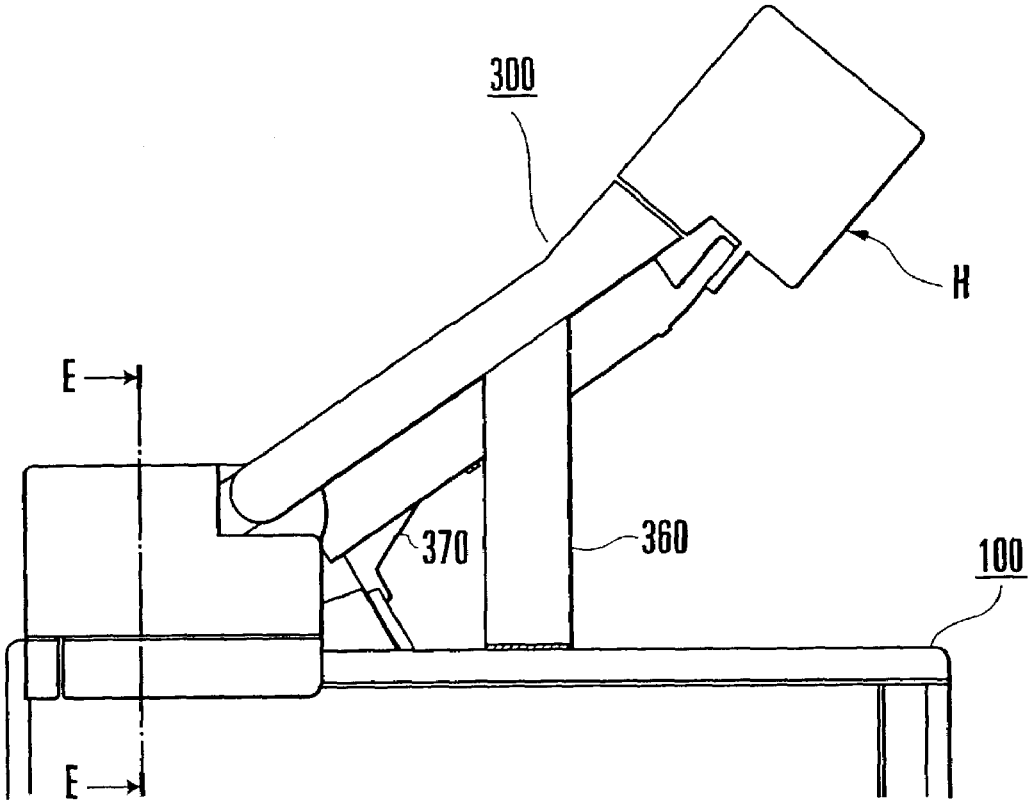
FIG. 14 is a front view for explaining the connection between the sheet processing apparatus and the image forming apparatus according to the invention.

FIG. 14 is a view obtained by simplifying the view of FIG. 1 showing the outline arrangement of the printer body 100 on which the sheet processing apparatus 300 is mounted. In addition, FIG. 15 is a view showing a section E—E of a connection part between the sheet processing apparatus 300 and the printer body 100 shown in FIG. 14.

Figure 15:
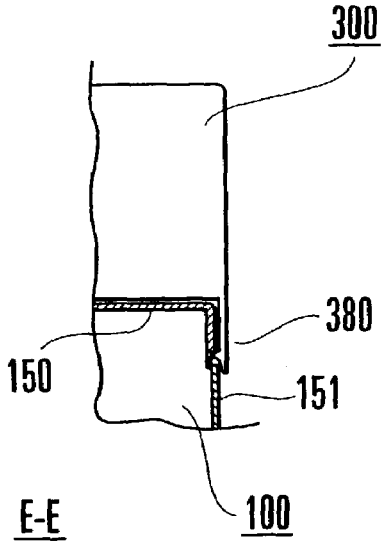
FIG. 15 is a front view for further explaining the connection between the sheet processing apparatus and the image forming apparatus according to the invention.

As is understandable from FIGS. 14 and 15, the mounting of the sheet processing apparatus 300 on the printer body 100 is effected by snap-fitting a connection part 380 of the sheet processing apparatus 300 to a recessed part formed at a joint between an exterior cover 150 and an exterior cover 151 of the printer body 100.

Figure 16:
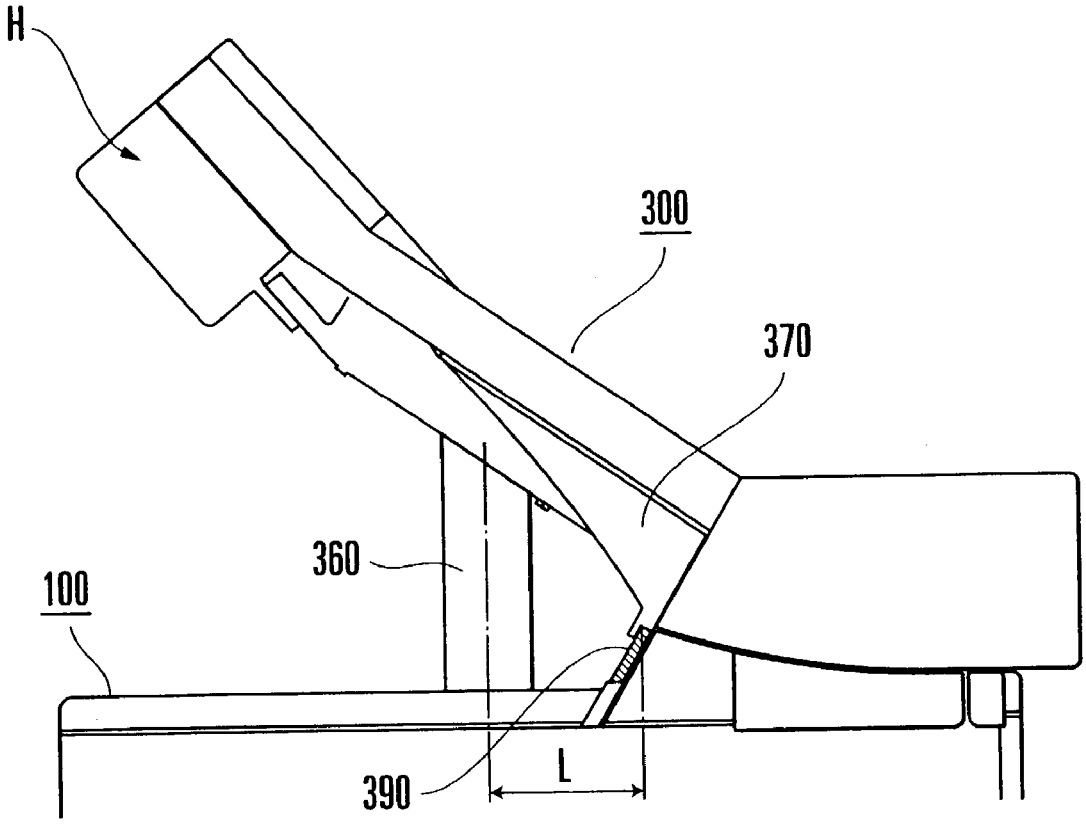
FIG. 16 is a view showing the sheet processing apparatus and the image forming apparatus as viewed from the side opposite to the side shown in FIG. 14.

As shown in FIG. 16, the arrangement of the sheet processing apparatus 300 and the image forming apparatus on the side opposite to the side shown in FIG. 14 is the same as that shown in FIG. 14. According to such an arrangement, even in a case where the sheet processing apparatus 300 is mounted, as an option, on the printer body 100, exterior covers of the printer body, which are conventionally provided, can be utilized without making a special alteration to the printer body 100, so that it is possible to reduce the cost of the printer body 100 and to prevent the fine appearance in design of the printer body 100 from being impaired.

Detachment of the sheet processing apparatus 300 from the printer body 100 can be effected by releasing the connection part 380 from snap-fitting.

Further, as shown in FIG. 16, support members 360 and 370 of the sheet processing apparatus 300, which abut on the printer body 100, are arranged such that, in consideration of the position of a stapling part (stapler) H serving as a sheet processing means, the support member 360, which is provided on the side for supporting the stapling part H being heavy, is disposed at a position nearer to the stapling part H than the support member 370, which is provided on the side not for supporting the stapling part H.

Thus, when the sheet processing apparatus 300 is viewed from the side as shown in FIG. 16, the support member 360 and the support member 370 are arranged in the state of shifting from each other by a distance L. This arrangement is provided for compensating for such a construction that the stapling part H in the present embodiment is disposed to staple the sheets on one end on the discharge direction side thereof and, therefore, the balance of weight between the right and left ends is not made. Accordingly, if the balance of weight is made symmetrical between the right and left ends by adjusting the position of the stapling part H or by additionally providing a weight member or the like, the disposition of the support members 360 and 370 should not be limited to the above-mentioned disposition.

Further, the sheet processing apparatus 300 may be arranged to be surely supported by adjusting the strength or the like of the supporting members.

In addition, in the present embodiment, the support member 370 is kept in contact with the casing part 100A of the printer body 100 at the position on a display panel 390 of the printer body 100. This arrangement prevents the visibility of the display panel 390 from being hindered by the support member 370.

Next, the outlines of the printer body 100 will be described along the conveying path for a sheet to be subjected to image formation.

As shown in FIG. 1, a feed cassette 200 is capable of accommodating a plurality of sheets to be subjected to image formation, and is arranged to sequentially feed the accommodated sheets one by one with the various rollers.

In addition to the sheet feeding action, a toner image is formed on a photosensitive member at an image forming part 101 disposed inside the printer body 100, on the basis of a printing signal transmitted from a computer or a network. The toner image formed on the photosensitive member is transferred onto the sheet S which has been fed from the feed cassette 200. Then, the toner image is semi-permanently fixed to the sheet S at a fixing part 120.

The sheet S having an image thus fixed thereto is turned up at an approximately-U-shaped sheet conveying path leading to a discharge roller 130, so that the top and bottom of the image-formed surface of the sheet S are reversed. Then, the sheet S is discharged outside from the printer body 100 by the discharge roller 130 in a state in which the image-formed surface faces downward.

In the present embodiment, the position of the flapper 301 in the sheet processing apparatus 300 is decided on the basis of a control signal supplied from a control part (not shown), so that, selectively, the sheet S is discharged to a face-down discharge part (a second sheet stacking portion) 125 provided on the upper surface part of the printer body 100 or the sheet S is conveyed to the side of the sheet processing apparatus 300.

Incidentally, in a case where a power source of the sheet processing apparatus 300 is not yet turned on or an accident occurs to the sheet processing apparatus 300, the flapper 301 is controlled in such a way as to be brought to the position for discharging the sheet S from the discharge roller 130 to the second sheet stacking portion 125, so that a sheet having an image formed thereon can be discharged without hindrance.

Further, while an image forming apparatus utilizing an electrophotographic process is used as the image forming apparatus according to the present embodiment, the invention is not limited to such an image forming apparatus, but is also applicable to an image forming apparatus of the ink-jet type in which an image is formed on a sheet by jetting ink. Thus, any image forming processes are applicable.

Further, while an image forming apparatus for forming an image on one side of the sheet is shown in the present embodiment, the invention is applicable to an image forming apparatus of the type having a construction for forming images on two sides of the sheet.

Next, the arrangement of the sheet processing apparatus 300 and the operation of each part of the sheet processing apparatus 300 in a case where the sheet S transported by the discharge roller 130 is conveyed to the sheet processing apparatus 300 will be described with reference to FIGS. 2(*a*) and 2(*b*) and FIGS. 3(*a*) and 3(*b*).

Figure 2A:
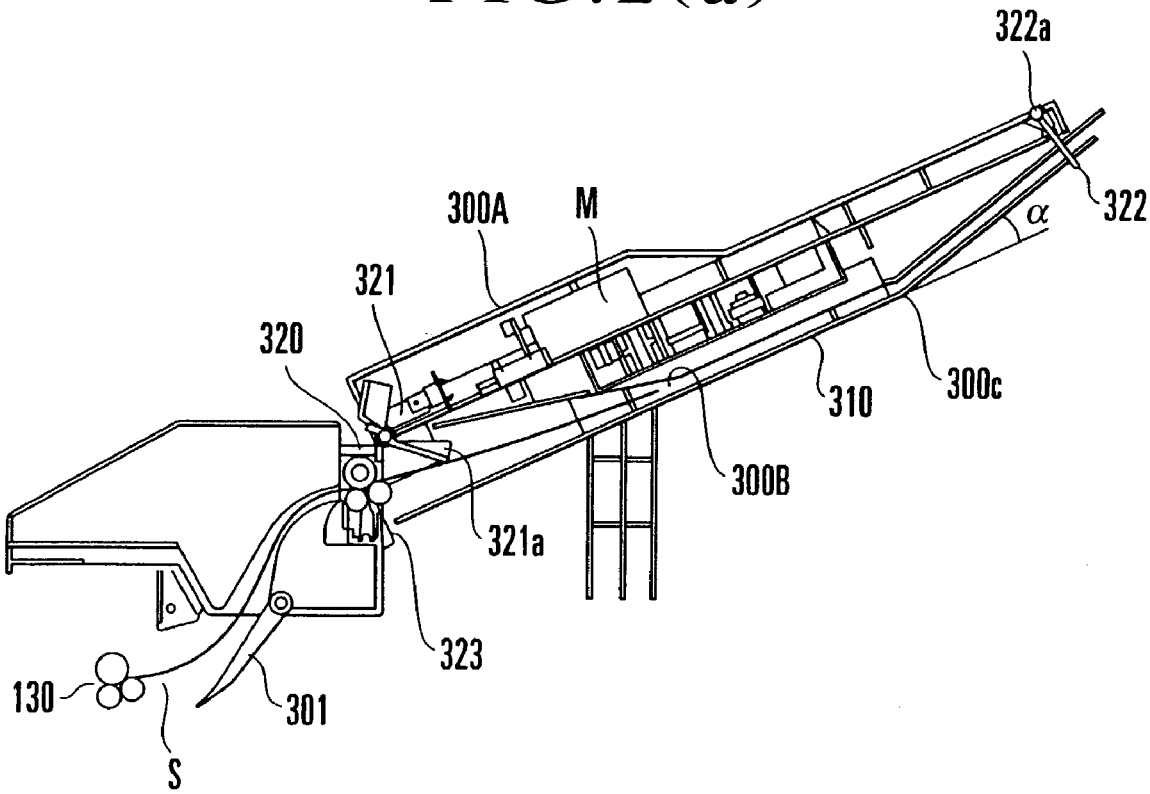
FIGS. 2(*a*) and 2(*b*) are sectional views for explaining the operation of the sheet processing apparatus according to the embodiment.
Figure 2B:
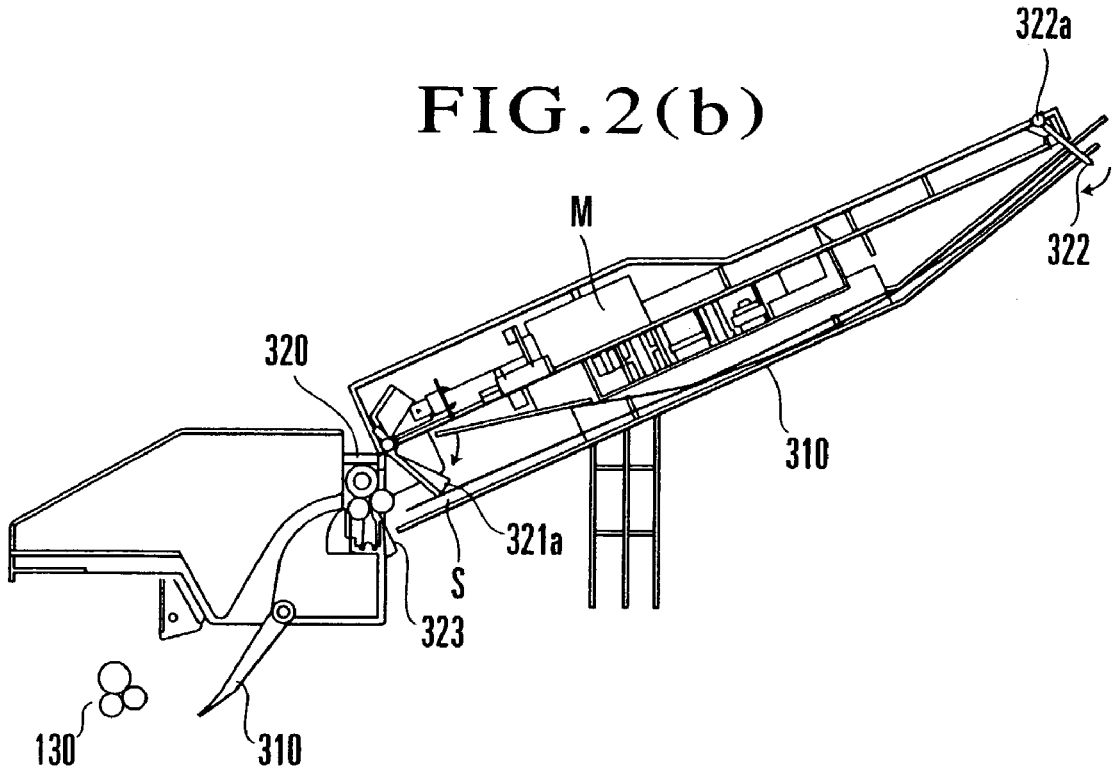

Here, FIGS. 2(*a*) and 2(*b*) show the sections of the discharge roller 130 and the sheet processing apparatus 300. FIG. 3(*a*) shows the section A—A of the sheet processing apparatus 300 shown in FIG. 1. FIG. 3(*b*) shows the section B—B of the sheet processing apparatus shown in FIG. 3(*a*).

In FIGS. 2(*a*) and 2(*b*), reference numeral 320 denotes a conveying roller, reference numeral 321 denotes a discharge sensor, reference character M denotes a jogger motor, reference numeral 322 denotes a sheet return member, and reference numeral 323 denotes a reference wall for abutting thereon the rear end of the sheet. These members will be described later.

As shown in FIGS. 2(*a*) and 2(*b*), the conveying roller 320 is disposed above the flapper 301, which serves as a switching means as mentioned above, on the downstream side in the sheet conveying direction, and is arranged to be driven to rotate by a driving motor (not shown). The discharge sensor 321 is disposed near the conveying roller 320 on the downstream side in the sheet conveying direction, and is arranged to detect the passage of the front end and rear end of the sheet as conveyed by the conveying roller 320. The jogger motor M is a motor capable of rotating forward and backward for driving slide guides 310 and 311, which serve as guide members, and is a stepping motor in the case of the present embodiment.

The sheet return member 322 is disposed, as shown in FIGS. 2(*a*) and 2(*b*), on the most downstream side in the sheet conveying direction in the sheet processing apparatus 300, and is arranged to be swingable around a pivot shaft part 322*a*. FIG. 2(*a*) shows the initial position of the sheet return member 322. FIG. 2(*b*) shows a state in which the sheet return member 322 is pushed up by the sheet S which has been conveyed up to the sheet return member 322.

The sheet return member 322 has a predetermined value of weight. When having being pushed up counterclockwise, as viewed in FIG. 2(*b*), by the sheet S, the sheet return member 322 is caused to swing in the direction of an arrow shown in FIG. 2(*b*) (clockwise) by being urged by a spring (not shown). Such a swinging force of the sheet return member 322 causes the rear end in the sheet conveying direction of the sheet S to abut on the reference wall 323, so that the alignment action in the sheet conveying direction is performed on the sheet S.

Incidentally, if the weight of the sheet return member 322 itself is arranged to be adjustable, the alignment action on the sheet S may be performed without utilizing the urging force of the spring.

Figure 3A:
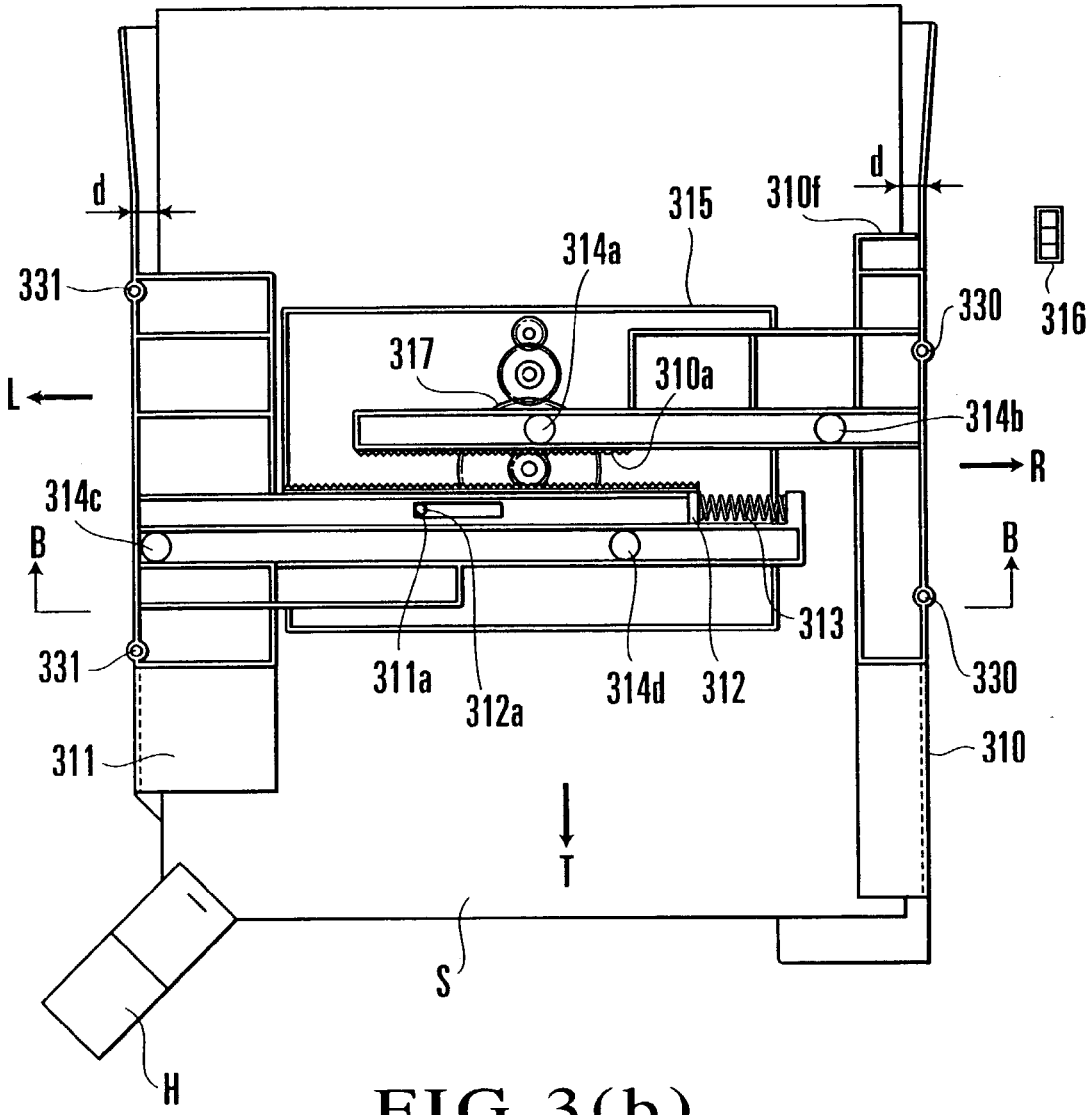
FIGS. 3(*a*) and 3(*b*) are sectional views for explaining the operation of slide guides in the embodiment, showing the state in which the slide guides are located at their standby positions.
Figure 3B:
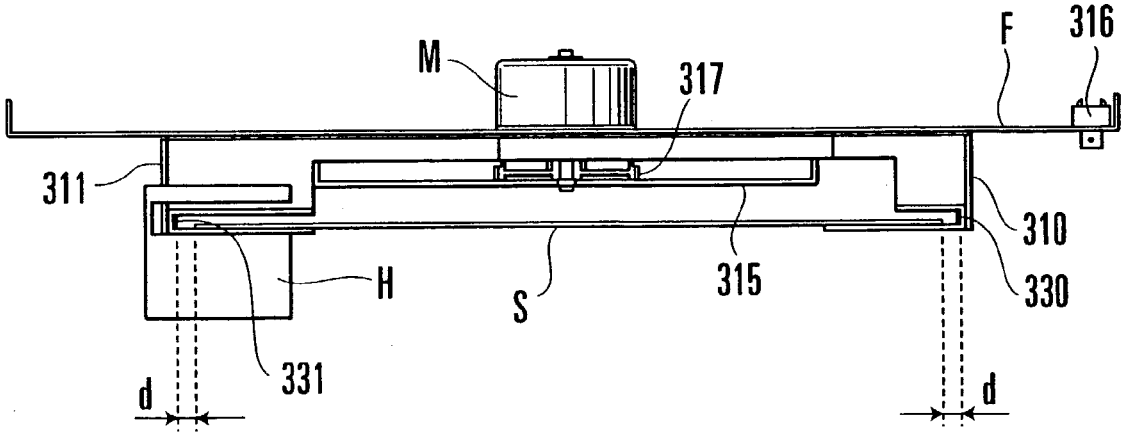

Subsequently, as shown in FIGS. 3(*a*) and 3(*b*), the sheet processing apparatus 300 is provided with the slide guide (R) 310 and the slide guide (L) 311, which will be described later, as guide members for aligning the sheet S in the width direction thereof.

In a case where a control means (not shown) performs control over a stapling operation in response to a command outputted beforehand from a computer or the like, the sheet processing apparatus 300 performs the stapling operation in the following manner. Before the sheet to be stapled is discharged by the discharge roller 130, the fore end side of the flapper 301 is made to be located at a lower position than that of a nip portion of the discharge roller 130 by a solenoid (not shown) through a link mechanism (not shown). Accordingly, as shown in FIG. 2(*a*), the sheet S discharged outside from the discharge roller 130 is led upward along the flapper 301, and is conveyed to the inside of the sheet processing apparatus 300. Then, the sheet S is transported to the first sheet stacking portion 300B, which is arranged to temporarily stack sheets.

The first sheet stacking portion 300B is composed of the slide guide (R) 310 and the slide guide (L) 311. There are provided no members for touching and supporting the sheet at a space between the slide guide (R) 310 and the slide guide (L) 311. In other words, the sheet S discharged to the first sheet stacking portion 300B is stacked with the right end part of the sheet S supported by the slide guide (R) 310 and the left end part of the sheet S supported by the slide guide (L) 311.

In this instance, in the sheet processing apparatus 300, as shown in FIG. 3(*a*), the slide guide (R) 310 and the slide guide (L) 311, which are disposed respectively on the right-hand side and the left-hand side with respect to the sheet discharging direction (an arrow T shown in FIG. 3(*a*)), retreat to their respective positions each of which is located outside by a predetermined amount with respect to the end of the width of the sheet S, so as not to interfere with the sheet S being conveyed, thus, waiting for the sheet S to come in.

Then, in the sheet processing apparatus 300, when the sheet S for the first time is discharged from the discharge roller 130 of the printer body 100, the sheet S is transported by the flapper 301 to the inside of the casing part 300A, and is discharged onto the guide surface of the first sheet stacking portion 300B, which is composed of the slide guide (R) 310 and the slide guide (L) 311, by the discharge roller 320, which is driven to rotate by a driving motor (not shown).

The guide surface of the first sheet stacking portion 300B is, as shown in FIG. 2(*a*), inclined by a predetermined angle with respect to the horizontal direction, and the angle of inclination differs with the upstream side and the downstream side of the guide surface of the first sheet stacking portion 300B in the sheet discharging direction. More specifically, there is formed a bend part 300C which is bent by an angle of inclination $\alpha$ between a predetermined section on the upstream side and a predetermined section on the downstream side.

With the bend part 300C thus provided, the guide surface of the first sheet stacking portion 300B is arranged to prevent a middle portion of the sheet S, which is not guided by the slide guides 310 and 311, from bending, with the rigidity of the sheet S utilized.

Incidentally, since the angle of inclination α depends on an angle of inclination of the slide guides 310 and 311, an angle which the second sheet stacking portion 125 makes with a horizontal plane, etc., it is not always necessary that the angle of inclination α differs with the upstream side and the downstream side in the sheet discharging direction. Thus, the angle of inclination α may be made zero.

Then, when detected by the discharge sensor 321 disposed near the discharge roller 320 on the downstream side, a fore end of the sheet S conveyed to the inside of the casing part 300A of the sheet processing apparatus 300 causes a flag 321*a* of the discharge sensor 321 to swing counterclockwise as viewed in FIG. 2(*a*).

Subsequently, when a rear end of the sheet S passes through the discharge roller 320, as shown in FIG. 2(*b*), the flag 321*a* swings, by its own weight, clockwise as viewed in FIG. 2(*b*), and the rear end of the sheet S is pushed downward by the flag 321*a*, so that the sheet S can be surely dropped to the guide surface composed of the slide guide (R) 310 and the slide guide (L) 311. At this time, the discharge sensor 321 turns off.

Further, as mentioned in the foregoing, although the fore end of the sheet S stacked on the first sheet stacking portion 300B tries to push up the sheet return member 322 counterclockwise as viewed in FIG. 2(*b*), the sheet return member 322, which is caused to swing in the direction of the arrow shown in FIG. 2(*b*) (clockwise) by being urged by the spring (not shown) causes the rear end of the sheet S to abut on the reference wall 323. Accordingly, the alignment action in the sheet conveying direction (in the longitudinal direction) is performed on the sheet S stacked on the first sheet stacking portion 300B.

The present embodiment is arranged such that, when the discharge sensor 321 turns off, only the slide guide (R) 310 on the right-hand side acts to start the alignment action in the width direction of the sheet S discharged on the first sheet stacking portion 300B.

More specifically, the slide guide (R) 310 is driven by the jogger motor M to move in the direction of an arrow L shown in FIG. 3(*a*), so that reference pins (R) 330 which are projections provided on the slide guide (R) 310 abut on the right side surface of the sheet S. Then, the slide guide (R) 310 pushes the sheet S, with the reference pins (R) 330, toward the slide guide (L) 311.

The left side surface of the sheet S pushed by the slide guide (R) 310 comes to abut on reference pins (L) 331 which are projections provided on the slide guide (L) 311. Accordingly, the sheet S is moved to a predetermined position.

Figure 4A:
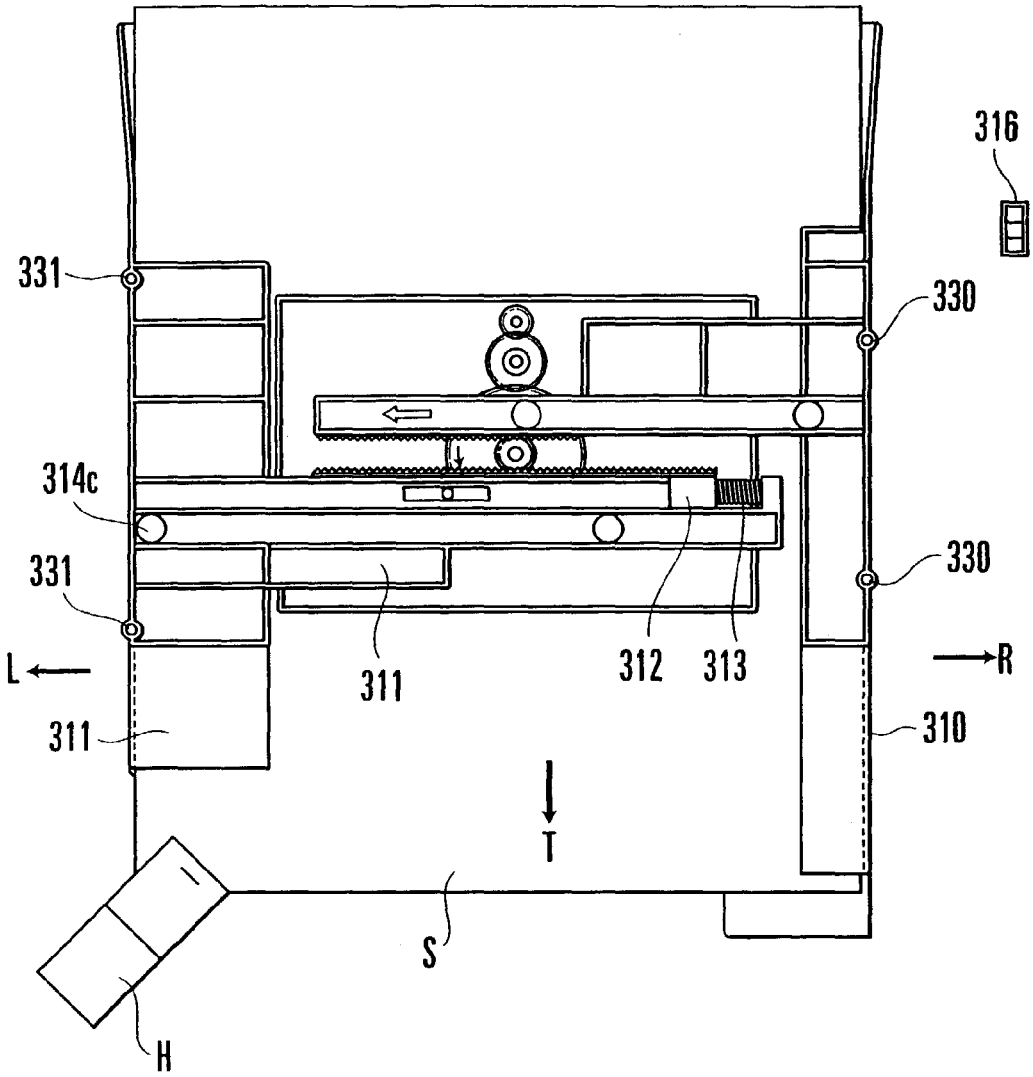
FIGS. 4(*a*) and 4(*b*) are sectional views for explaining the operation of the slide guides in the embodiment, showing the state in which sheets have been aligned by the slide guides.
Figure 4B:
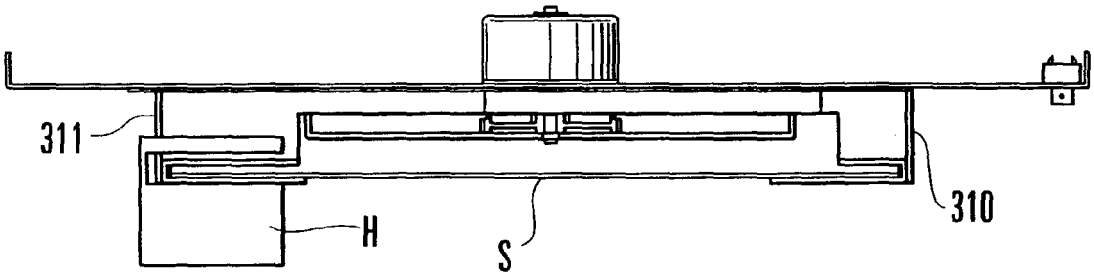

Here, the construction of the slide guides 310 and 311 will be described further in detail. FIGS. 3(*a*) and 3(*b*) show the section A—A of the sheet processing apparatus 300 shown in FIG. 1. FIGS. 4(*a*) and 4(*b*) and FIGS. 5(*a*) and 5(*b*) are sectional views for explaining the operation of the slide guides 310 and 311. In addition, FIG. 3(*a*) shows the sheet processing apparatus 300 as viewed from the side of the jogger motor M shown in FIG. 3(*b*), with a frame F shown in FIG. 3(*b*) removed.

The slide guides 310 and 311 are arranged to move to the right and to the left in FIG. 3(*a*) (in the width direction of the sheet), i.e., in directions perpendicular to the sheet conveying direction (the arrow T shown in FIG. 3(*a*)), by receiving a driving force transmitted from the jogger motor M, while being guided by guide pins 314*a*, 314*b*, 314*c* and 314*d* provided on the frame F of the sheet processing apparatus 300.

Further, in the state shown in FIG. 3(*a*), the slide guide (L) 311 is restrained from moving further in the direction of the arrow R because of abutting on the guide pin 314*c*. The position of the guide pin 314*c* is decided with respect to the position of the stapling part H. Since the stapling part H in the present embodiment is fixed to the sheet processing apparatus 300, it is necessary to perform the alignment action on the sheet S with the stapling part H always used as a point of reference. The reason for this is that, if the slide guide (L) 311 is moved to the side in the direction of the arrow R beyond the stapling part H at the time of the alignment action, the stapling operation becomes impossible.

Therefore, the moving range of the guide slide (L) 311 is restricted by the guide pin 314*c*.

As shown in FIG. 3(*b*) when viewed from the sheet conveying direction, each of the slide guides 310 and 311 is composed of a wall part arranged to guide each side surface of the sheet S and a guide part arranged to support the upper and lower surfaces of the sheet S. Since the sheet S is supported by the lower surface of the guide part of each of the slide guides 310 and 311, a middle portion of the sheet S in the width direction thereof is not supported.

The first sheet stacking portion 300B is provided with a stepped gear 317, which is arranged to receive a driving force from the jogger motor M. Then, the slide guide (R) 310 is provided with a rack part 310*a* having an open toothed part, which meshes with the stepped gear 317.

On the other hand, at a position opposite to the rack part 310*a* across the stepped gear 317, there is provided a slide rack 312. The slide rack 312 has also an open toothed part, which meshes with the stepped gear 317.

The slide rack 312 is arranged to be relatively movable with respect to the slide guide (L) 311 via a coiled spring 313. The spring 313 has its one end engaging with the slide guide (L) 311 and its other end engaging with the slide rack 312. Then, the spring 313 is arranged to have its spring force acting in such a way as to extend the space between the slide guide (R) 311 and the slide rack 312.

Further, the slide rack 312 has an embossed part 312*a*, which moves inside a rectangular hole part 311*a* formed on the slide guide (L) 311 as a slot extending in the width direction of the sheet, and is thus arranged to fit into the slide guide (L) 311.

Further, the slide guide (R) 310 and the slide guide (L) 311 have their positions in the height direction regulated by the stepped gear 317 and a height regulating member 315.

The side wall of the slide guide (R) 310 is provided with two reference pins (R) 330, and the side wall of the slide guide (L) 311, too, is provided with two reference pins (L) 331. Then, when the alignment action on the sheets in the width direction thereof is performed, the slide guide (R) 310 moves to cause the reference pins (R) 330 and the reference pins (L) 331 to abut on the right and left end surfaces of the sheet S, respectively. Accordingly, the sheets S stacked on the first sheet stacking portion 300B are aligned in respect of the position in the width direction.

Incidentally, the reference pins (R) 330 and the reference pins (L) 331 are made of material having high abrasion resistance (rigidity). The reason for this is that, if a portion abutting on the sheet is abraded when the sheet processing apparatus 300 has performed the alignment action on the sheets a great number of times, it becomes impossible to perform a high-accurate alignment action.

Next, the operation of the slide guides (R) 310 and (L) 311 will be described.

When a power source of the sheet processing apparatus 300 is turned on, the discharge roller 320 is driven by the driving motor to start rotating. Subsequently, when the jogger motor M is rotated to cause the stepped gear 317 to rotate, a driving force is transmitted to the rack part 310*a* of the slide guide (R) 310, so that the slide guide (R) 310 retreats outside (in the direction of the arrow R in FIG. 3(*a*)).

Further, similarly, the slide rack 312 is moved in the direction of the arrow L. when the embossed part 312*a* of the slide rack 312 abuts on the left-side end surface (as viewed in FIG. 3(*a*)) of the rectangular hole part 311*a* of the slide guide (L) 311, the slide guide (L) 311 is pushed by the embossed part 312*a* to retreat outside (in the direction of the arrow L in FIG. 3(*a*)).

Figure 5A:
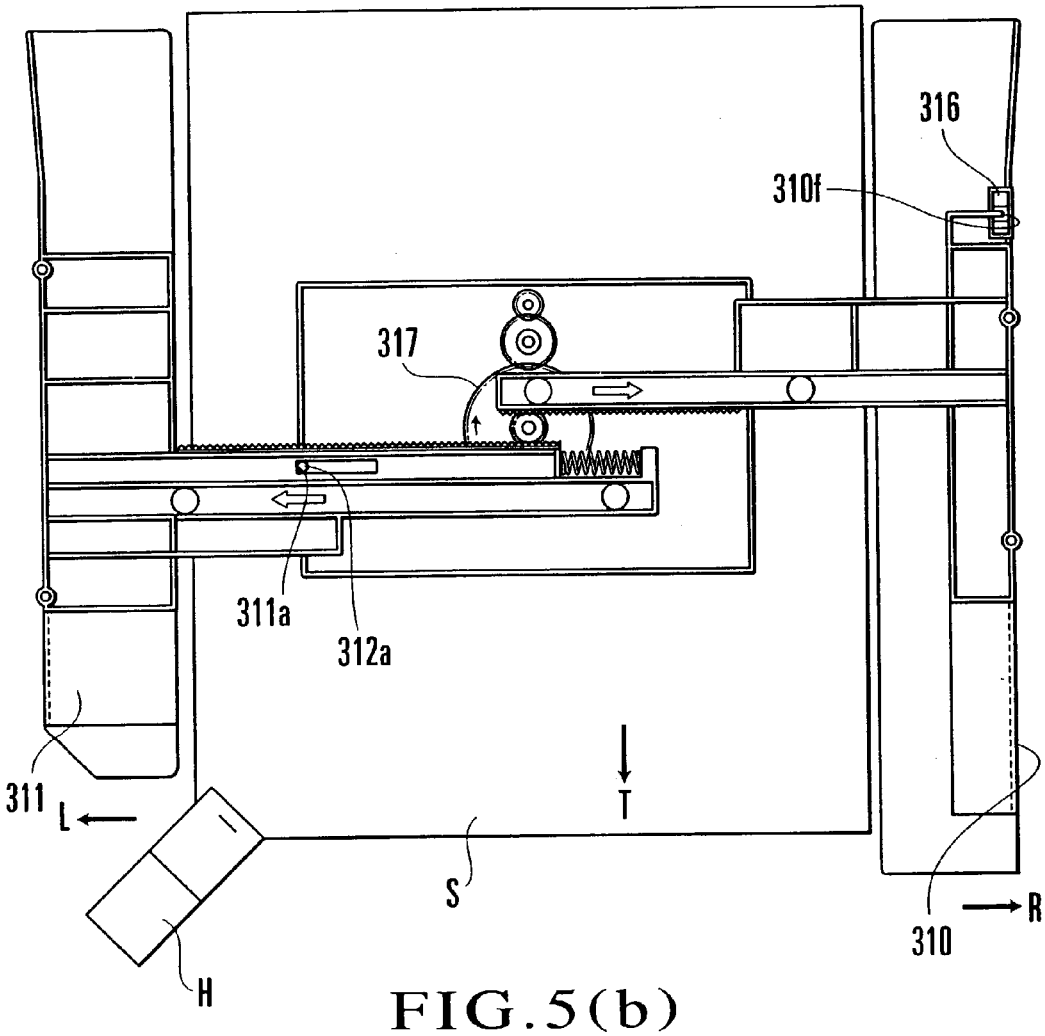
FIGS. 5(*a*) and 5(*b*) are sectional views for explaining the operation of the slide guides in the embodiment, showing the state in which the slide guides are located at their home positions and the sheets are dropping.
Figure 5B:
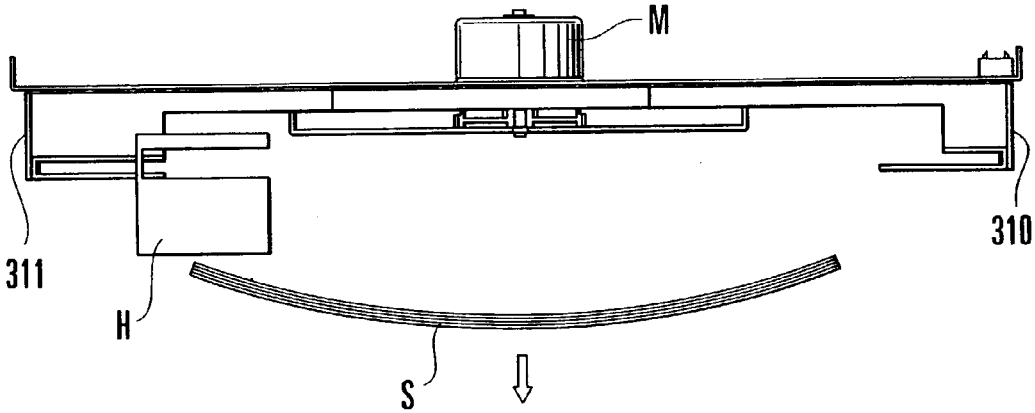

The slide guide (R) 310 is provided with a flag part 310*f*. When the flag part 310*f* is moved up to a predetermined retreat position, as shown in FIG. 5(*a*), the flag part 310*f* blocks light incident on a photo-sensor 316, thereby turning off the photo-sensor 316. At this point of time, the jogger motor M comes to a stop. This position is referred to as the "home position" of the sheet processing apparatus 300.

After the above-stated initial operation is performed on the sheet S, when a signal indicating that the sheet S enters the sheet processing apparatus 300 is inputted from the printer body 100 to the sheet processing apparatus 300, the jogger motor M rotates in the direction reverse to the direction employed for the initial operation, so that the slide guide (R) 310 and the slide guide (L) 311 move inward. Then, each of the slide guide (R) 310 and the slide guide (L) 311 comes to a stop at such a position as to be wider by a predetermined amount "d" than the width of the sheet S discharged to the first sheet stacking portion 300B, as shown in FIGS. 3(*a*) and 3(*b*). In this position, the slide guide (L) 311 abuts on the guide pin 314*c* and is thus prevented from moving further in the direction of the arrow R. In the present embodiment, the position shown in FIGS. 3(*a*) and 3(*b*) is referred to as the "standby position". In the standby position, the reference pins (L) 331 of the slide guide (L) 311 are used as the reference position for the alignment action.

In the present embodiment, the standby position of each of the slide guide (R) 310 and the slide guide (L) 311 is set in such a manner that, in a case where the size (width) of the sheet S is the largest of sizes of sheets which can pass through the sheet processing apparatus 300, each of gaps appearing on the both sides of the sheet S has the predetermined amount "d".

Incidentally, in a case where sheets which are narrower in width than the sheet of the largest size are aligned in the sheet processing apparatus 300, the slide guide (R) 311 moves in the direction of the arrow L by an amount corresponding to such a difference in width, so that a gap between the sheet and the slide guide (R) 310 in the standby position has always the predetermined amount "d". In this case, a gap between the sheet and the slide guide (L) 311 becomes wider by an amount corresponding to half of the difference in sheet width than the predetermined amount "d".

Now, when the sheet S for the first time is discharged from the discharge roller 130 of the printer body 100, the sheet S is transported to the inside of the sheet processing apparatus 300 with the transporting direction of the sheet S controlled by the flapper 301. Then, the sheet S is discharged onto the slide guides 310 and 311 by the discharge roller 320.

In this instance, after the fore end of the sheet S is detected by the discharge sensor 321, the sheet S is conveyed along the supporting surfaces of the slide guides 310 and 311 (the lower surface parts of guide parts), so that the left-side corner part of the fore end (the left and bottom end part shown in FIG. 3(*a*)) of the sheet S enters an opening part of the stapling part H.

Further, the fore end of the sheet S abuts on the sheet return member 322, and, then, the rear end part of the sheet S is aligned with respect to the reference wall 323 by the action of the sheet return member 322.

Further, when the rear end of the sheet S comes off the discharge roller 320 to turn off the flag 321*a* of the discharge sensor 321, the rear end side of the sheet S is pushed downward by the flag 321*a*, as mentioned in the foregoing, so that the sheet S is caused to surely drop to the supporting surfaces of the first sheet stacking portion 300B, which is composed of the slide guides (R) 310 and (L) 311.

In the present embodiment, when the discharge sensor 321 has turned off, the jogger motor M starts rotating, so that the slide guides (R) 310 and (L) 311, which have been in the standby position, begin the alignment action in the following manner.

First, the jogger motor M rotates in such a direction as to cause the slide guide (R) 310 to move inward (in the direction of the arrow L). Accordingly, the slide guide (R) 310 moves in the direction of the arrow L to abut on the right-side end part of the sheet S.

Further, the rotation of the jogger motor M is transmitted to the slide rack 312, so that the slide rack 312 moves inward (in the direction of the arrow R). At this time, the spring 313 is compressed by the slide rack 312. Since the end part of the spring 313 as compressed, which part is opposite to the side thereof engaging with the slide rack 312, is engaging with the slide guide (L) 311, a force with which the spring 313 as compressed tries to expand acts on the slide guide (L) 311. Therefore, the slide guide (L) 311 tires to move in the direction of the arrow R.

However, since, in the standby position, the slide guide (L) 311 is in the state of abutting on the guide pin 314*c*, the slide guide (L) 311 is restrained from moving inward (in the direction of the arrow R). Therefore, during the alignment action, only the slide guide (R) 310 moves for aligning the sheet S.

In the alignment action, first, with the slide guide (R) 310 moving in the direction of the arrow L, the reference pins (R) 330 abut on the right-side end surface of the sheet S, and then push the sheet S toward the slide guide (L) 311. Then, when the left-side end surface of the sheet S abuts on the reference pins (L) 331, there is obtained the state shown in FIGS. 4(*a*) and 4(*b*). Incidentally, in consideration of any bending of the sheet S, etc., the slide guide (R) 310 may be moved up to a position where the interval between the reference pins (R) 330 and (L) 331 becomes narrower than the length of the sheet S in the width direction thereof.

The jogger motor M temporarily stops when there has been obtained the state shown in FIGS. 4(*a*) and 4(*b*) in which the both side end parts of the sheet S abut on the slide guides 310 and 311. After that, the jogger motor M starts rotating reversely and then stops when the slide guides (R) 310 and (L) 311 have come again to the standby position shown in FIGS. 3(*a*) and 3(*b*). The control action on the amount of movement of the slide guide (R) 310 in such a series of operations is managed on the basis of the number of driving pulses for the jogger motor M, being a stepping motor, with the home position, where the photo-sensor 316 is light-blocked, taken as a reference point.

In addition, during the operation in which the slide guide (R) 310 returns to the standby position, while the slide rack 312 also moves in such a direction as to expand the spring 313, the slide guide (L) 311 itself does not move, being kept in the standby position. Accordingly, the left-side end part of the sheet S, as viewed in FIG. 4(*a*), is kept in the state of abutting on the slide guide (L) 311.

Next, when a sheet S2 for the second time is conveyed to the sheet processing apparatus 300 similarly to the sheet S for the first time, and the rear end of the sheet S2 passes through the discharge sensor 321, the sheet S2 is superposed on the sheet S. Then, with such a state, the alignment action is started similarly to the case of the sheet S for the first time.

More specifically, with the jogger motor M rotating, the slide guide (R) 310 moves and the reference pins (R) 330 abut on the right-side end surface of the sheet S2. The slide guide (R) 310 moves further up to a position where the left-side end surface of the sheet S2 abuts on the reference pins (L) 311 provided on the slide guide (L) 311. Accordingly, the sheet S2 is aligned similarly to the sheet S for the first time. After that, the slide guide (R) 310 moves up to the standby position and then stops.

The above operation is performed until the last sheet Sn (for the n-th time) in one job is aligned. Then, in the state in which the reference pins (R) 330 provided on the slide guide (R) 310 cause the left-side end surfaces of the sheets to abut on the reference pins (L) 331 of the slide guide (L) 311, i.e., in the state in which the alignment action has been performed as shown in FIGS. 4(*a*) and 4(*b*), the sheets are stapled by the stapling part H, which is located on the left side of the fore end of the sheet bundle.

Incidentally, the stapling action of the stapling part H is performed in such a manner that, since the sheets are stacked serially from the first page with an image-formed surface of each sheet facing downward, needles are driven into the sheet bundle upward from below.

According to the above-described construction and operation, during the alignment action on each sheet, the slide guide (L) 311 is stopped in the standby position without moving, and only the slide guide (R) 310 moves to cause the left-side end part of each sheet to align to the reference position for stapling. Accordingly, the stapling part H, which is disposed on the side of the slide guide (L) 311, is enabled to perform the sheet stapling action accurately and simply.

Further, even in a case where sheets conveyed to the sheet processing apparatus 300 for one job vary in width, or even in a case where the sheet size varies from the size "LTR" to the size "A4" or the like, the left-side end part of each sheet is aligned to the constant position in respect of the width of each sheet. Therefore, the stapling part H is enabled to perform a stapling process excellent in accuracy and precision.

Subsequently, when the stapling action is completed as described above, the jogger motor M is driven to rotate, so that the slide guide (R) 310 and the slide guide (L) 311 move in the direction of the arrow R and in the direction of the arrow L, respectively, from the state shown in FIG. 4(*a*). Incidentally, since, at the time of start of rotation of the jogger motor M, the slide rack 312 first moves to the left as viewed in FIG. 4(*a*), the slide guide (L) 311 itself does not immediately move.

When the slide guide (R) 310 passes over the standby position shown in FIG. 3(*a*), the embossed part 312*a* of the slide rack 312 abuts on the end surface of the rectangular hole part 311*a* of the slide guide (L) 311. Then, the slide guide (L) 311 starts moving in the direction of the arrow L by being pushed by the embossed part 312*a*, so that both the slide guides 310 and 311 move.

When the interval between the slide guides 310 and 311, which are supporting the sheet bundle as stapled, becomes equal to or wider than the sheet width, the sheet bundle drops downward as shown in FIGS. 5(*a*) and 5(*b*). Accordingly, the sheet bundle drops to the face-down discharge part (the second sheet stacking portion) 125, which is provided on the upper surface of the casing part 100A of the printer body 100, and is stacked there.

As mentioned above, in the present embodiment, the face-down discharge part 125 of the printer body 100 is used also as a stacking part for the sheet bundle discharged from the sheet processing apparatus 300, without providing any dedicated stacking part for the sheet bundle. Therefore, the size of the sheet processing apparatus 300 can be reduced.

Further, in the present embodiment, the sheet processing apparatus 300 is mounted on the upper portion of the casing part 100A of the printer body 100, and the conveying path for a sheet discharged from the printer body 100 in the face-down manner is changed over by the flapper 301. This arrangement obviates the necessity of provision of an inverting mechanism for discharging and stacking image-formed sheets in the order of page numbers, which mechanism is required in conventional processing apparatuses. Therefore, the size of the sheet processing apparatus 300 can be reduced with space saving and at low cost.

Incidentally, if, after the sheet bundle as stapled is made to drop to the face-down discharge part 125 of the printer body 100, a sheet is discharged directly to the face-down discharge part 125 from the discharge roller 130 of the printer body 100, there is the possibility that, depending on the position of the sheet bundle stacked on the face-down discharge part 125, a fore end of the thus-discharged sheet is caught by a stapled portion of the sheet bundle and the sheet is then damaged, the alignment of sheets or sheet bundles is impaired, or jamming occurs in sheets.

In order to prevent the occurrence of such inconveniences, the operation of the printer body 100 and the sheet processing apparatus 300 is controlled as follows. After a sheet bundle stapled by the stapling part H is discharged to the face-down discharge part 125, at least the first sheet which is discharged next is made to drop to the face-down discharge part 125 through the sheet processing apparatus 300 without being discharged directly to the face-down discharge part 125 from the printer body 100.

This operation makes it possible to cover the stapled portion of a sheet bundle as earlier discharged, with a sheet which is next dropping. Therefore, even if, after that, a sheet is discharged directly to the face-down discharge part 125, the above-mentioned inconveniences can be solved.

Further, while, in the present embodiment, during the alignment action on sheets, only the slide guide (R) 310 moves and the slide guide (L) 311 does not move, the slide guide (L) 311 may be made to move during the alignment action on sheets. In such a case, for example, this arrangement can be realized by making the slide guide (L) 311 have the same construction as the slide guide (R) 310. Incidentally, in a case where the alignment action on sheets is performed by moving both the slide guides 310 and 311, it goes without saying that the construction and control operation for appropriately aligning sheets to the position of the stapling part H become necessary.

Further, while, in the present embodiment, both the slide guides are made to move so as to cause the sheets subjected to the alignment action to drop, only one of the slide guides may be made to move so as to cause the sheets to drop. This arrangement will be described later as another embodiment of the invention.

Further, while a processing means is exemplified by the stapling part H for stapling sheets, the invention is applicable, with the similar construction and control operation, to a means for performing a process after aligning sheets, such as a punching means for punching sheets, a binding means for fixing sheets with paste or the like, etc.

Further, while, in the present embodiment, a predetermined process is performed on sheets as aligned, the invention is not limited to this arrangement and may be arranged to cause sheets which are not subjected to a process after being aligned to drop to the second sheet stacking portion 125. For example, if a sheet stacking position obtained by discharging sheets directly to the second sheet stacking portion 125 from the discharge roller 130 and a sheet stacking position obtained by aligning sheets at the first sheet stacking portion 300B and causing the sheets to drop are made to shift from each other in the sheet width direction or in the sheet discharging direction, it becomes possible to perform a sorting control operation.

As has been described above, in the present embodiment of the invention, a sheet processing apparatus is disposed above a sheet discharge part of an image forming apparatus, sheets discharged onto a sheet stacking portion of the sheet processing apparatus are aligned and subjected to a predetermined process, and, after that, the sheets are dropped and stacked on the sheet discharge part of the image forming apparatus by moving the sheet stacking portion. This arrangement makes it possible to realize the simplification and cost reduction of the sheet processing apparatus and to save space in mounting the sheet processing apparatus on the image forming apparatus or the like.

Figure 6A:
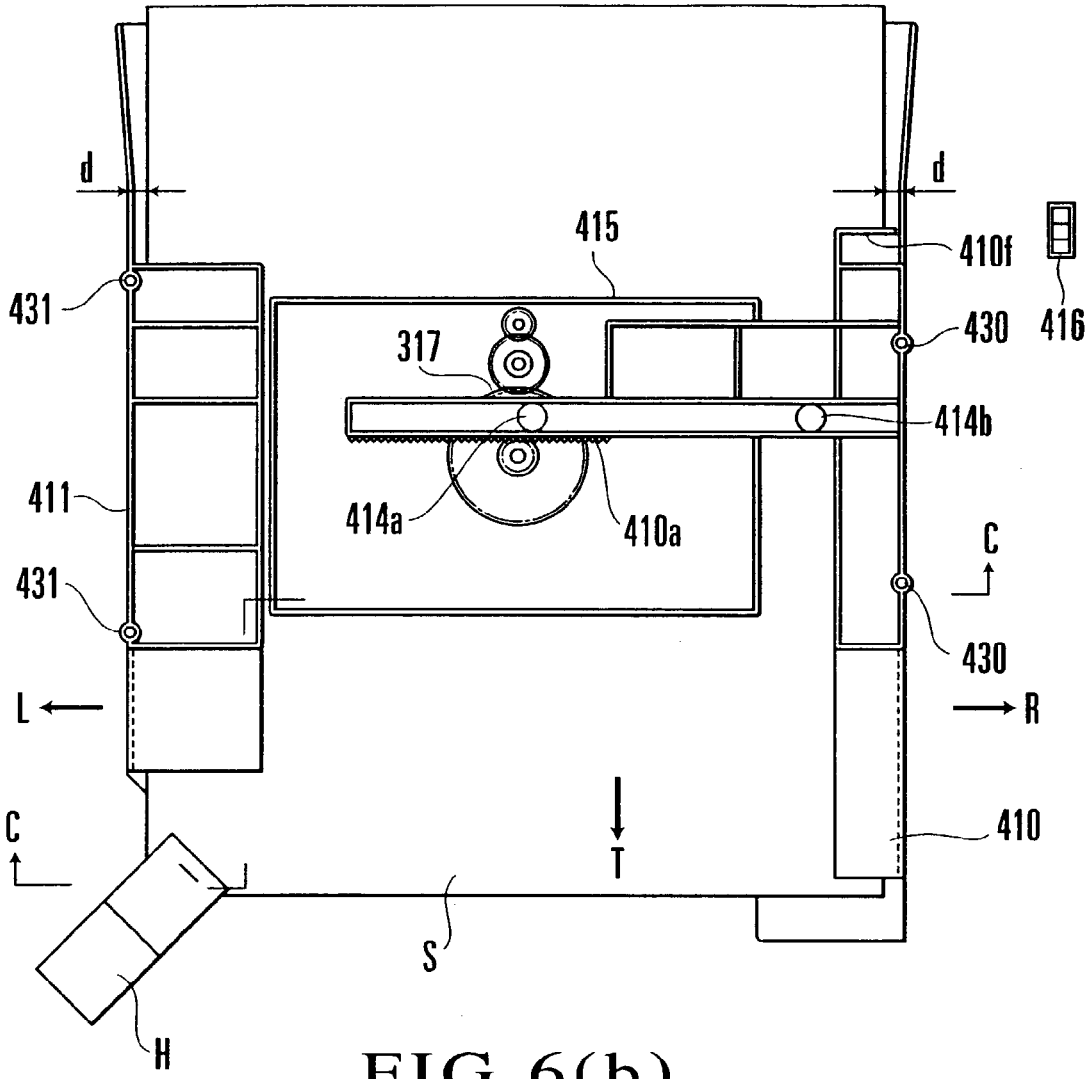
FIGS. 6(*a*) and 6(*b*) are sectional views for explaining the arrangement and operation of a slide guide and a fixed guide in another embodiment of the invention, showing the state in which the slide guide is located at its standby position.
Figure 6B:
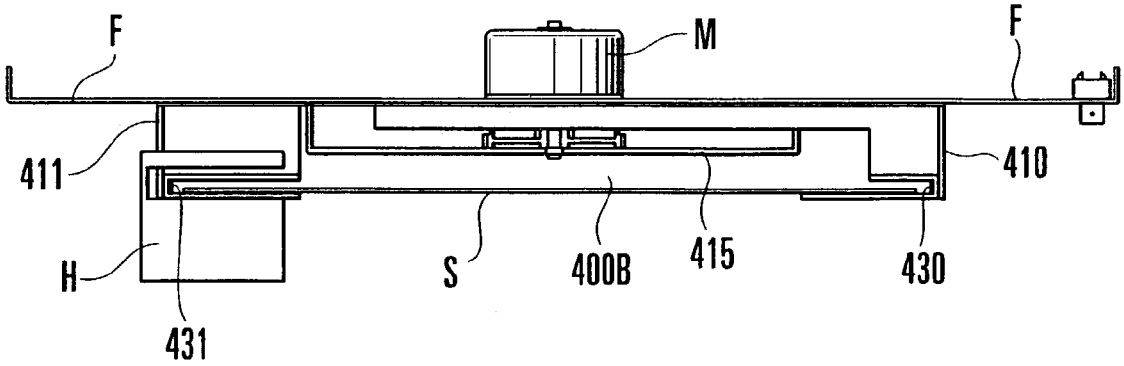
Figure 8A:
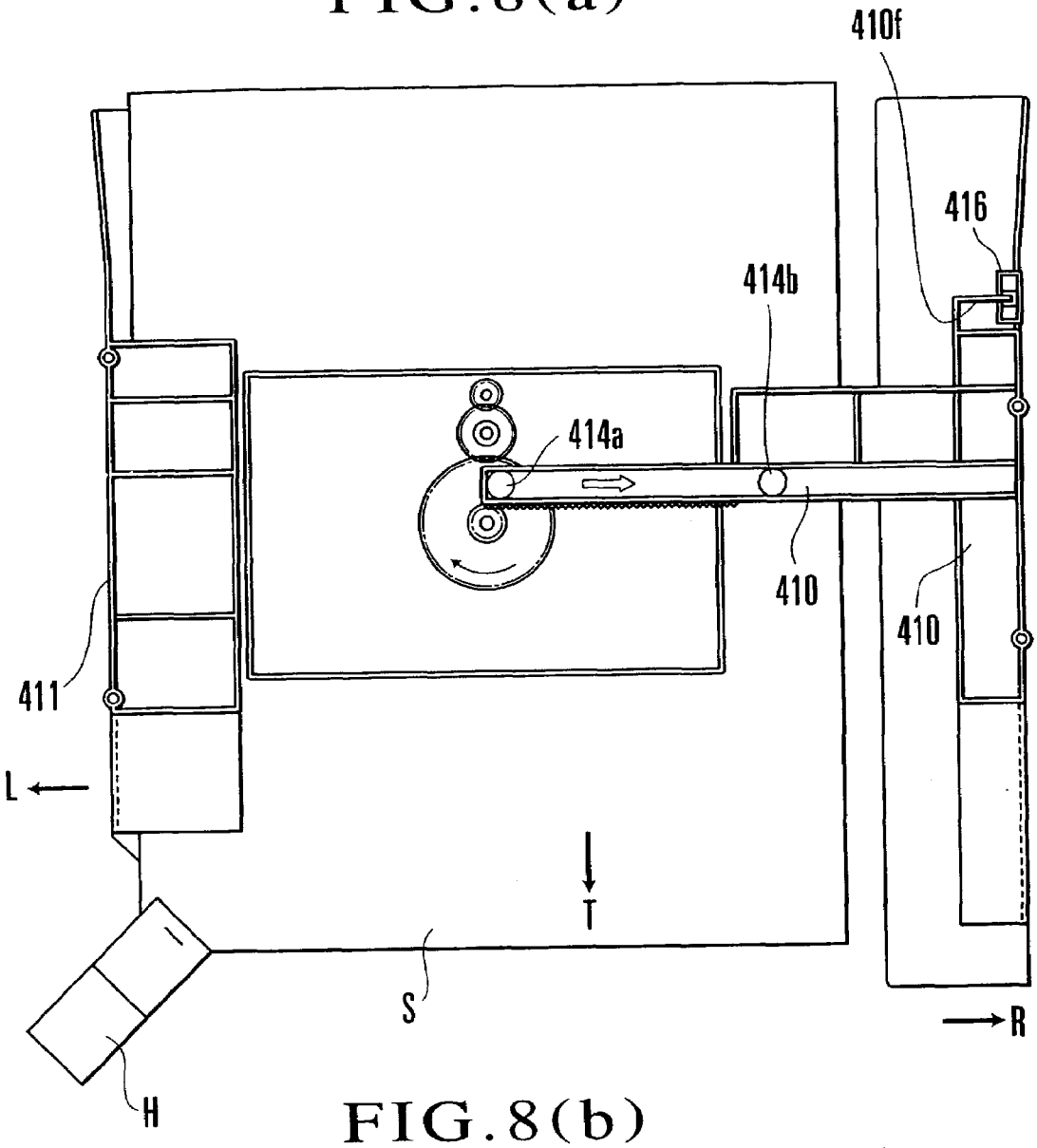
FIGS. 8(*a*) and 8(*b*) are sectional views for explaining the operation of the slide guide in the embodiment shown in FIGS. 6(*a*) and 6(*b*), showing the state in which the slide guide is located at its home positions and the sheets are dropping.
Figure 8B:
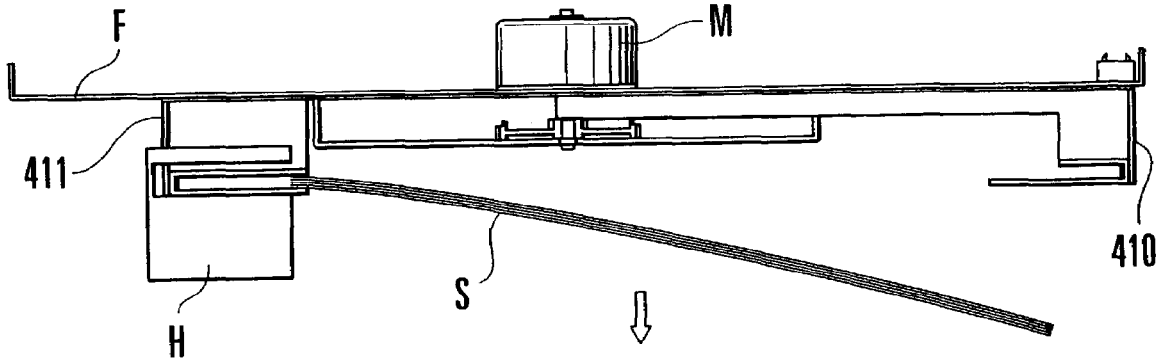

Next, a sheet processing apparatus according to another embodiment of the invention will be described with reference to FIGS. 6(*a*) and 6(*b*) to FIGS. 8(*a*) and 8(*b*). FIG. 6(*a*) shows the sheet processing apparatus 300 as viewed from above, and FIG. 6(*b*) shows the section C—C of the sheet processing apparatus 300 shown in FIG. 6(*a*).

While, in the first-mentioned embodiment, both the slide guides on the right and left sides are made to move when causing sheets which have been temporarily stacked on the first sheet stacking portion 300B and have been aligned to drop, the present embodiment is arranged such that, for the purpose of furthering the simplification and cost reduction of the sheet processing apparatus 300, one guide member (L) 411 (hereinafter referred to as the fixed guide (L) 411) is fixed and only the other guide member (R) 410 (hereinafter referred to as the slide guide (R) 411) is made to move.

In the following, a first sheet stacking portion 400B of the sheet processing apparatus 300 according to the present embodiment will be described. It is to be noted that the members similar to those described in the foregoing description are omitted from the description here.

The slide guide (R) 410 is provided with a rack part 410*a* having an open toothed part which meshes with the stepped gear 317. On the other hand, the fixed guide (L) 411 is fixed to the frame F, and the position of the fixed guide (L) 411 is the standby position in the first-mentioned embodiment (i.e., the reference position for stapling). Accordingly, a gap between the left-side end of the sheet conveyed and discharged onto the first sheet stacking portion 400B and the fixed guide (L) 411 becomes the predetermined amount "d".

The slide guide (R) 410 is arranged to be movable to the right and to the left as viewed in FIG. 6(*a*), i.e., to be capable of making a reciprocating motion in the sheet width direction which is perpendicular to the sheet conveying direction. The slide guide (R) 410 is driven to move by the jogger motor M. Further, the slide guide (R) 410 has its position in the height direction regulated by the stepped gear 317 and a height regulating member 415.

Next, the operation of the slide guides (R) 410 will be described. When a power source of the sheet processing apparatus 300 is turned on, the discharge roller 320 is driven by a conveying motor (not shown) to start rotating. Subsequently, when the jogger motor M is rotated to cause the stepped gear 317 to rotate, a driving force is transmitted to the rack part 410*a* of the slide guide (R) 410, so that the slide guide (R) 410 retreats outside (in the direction of the arrow R in FIG. 6(*a*)).

The slide guide (R) 410 is provided with a flag part 410*f*. When the flag part 410*f* is moved up to a predetermined retreat position, as shown in FIG. 8(*a*), the flag part 410*f* blocks light incident on a photo-sensor, thereby turning off the photo-sensor. At this point of time, the jogger motor M comes to a stop. This position is referred to as the "home position" of the sheet processing apparatus 300.

After the above-stated initial operation is performed on the sheet S, when a signal indicating that the sheet S enters the sheet processing apparatus 300 is inputted from the printer body 100 to the sheet processing apparatus 300, the jogger motor M rotates in the direction reverse to the direction employed for the initial operation, so that the slide guide (R) 410 moves inward (in the direction of the arrow L in FIG. 6(*a*)). Then, the slide guide (R) 410 comes to a stop at such a position as to be wider by the predetermined amount "d" than the width of the sheet S discharged to the first sheet stacking portion 400B, as shown in FIGS. 6(*a*) and 6(*b*).

Now, when the sheet S for the first time is discharged from the discharge roller 130 of the printer body 100, the sheet S is transported to the inside of the sheet processing apparatus 300 with the transporting direction of the sheet S controlled by the flapper 301. Then, the sheet S is discharged by the discharge roller 320 onto the first sheet stacking portion 400B, which is composed of the slide guide (R) 410 and the fixed guide (L) 411.

In this instance, after the fore end of the sheet S is detected by the discharge sensor 321, the sheet S is conveyed along the supporting surfaces of the slide guides (R) 410 and the fixed guide (L) 411 (the lower surface parts of guide parts), so that the left-side corner part of the fore end (the left and bottom end part shown in FIG. 6(*a*)) of the sheet S enters an opening part of the stapling part H.

Further, the fore end of the sheet S abuts on the sheet return member 322, and, then, the rear end part of the sheet S is aligned with respect to the reference wall 323 by the action of the sheet return member 322.

Further, when the rear end of the sheet S comes off the discharge roller 320 to turn off the flag 321*a* of the discharge sensor 321, the rear end side of the sheet S is pushed downward by the flag 321*a*, as mentioned in the foregoing, so that the sheet S is caused to surely drop to the supporting surfaces of the first sheet stacking portion 400B, which is composed of the slide guide (R) 410 and the fixed guide (L) 411.

In the present embodiment, when the discharge sensor 321 has turned off, the jogger motor M starts rotating, so that the slide guide (R) 410, which has been in the standby position, begins the alignment action in the following manner.

First, at the time of start of the alignment action, the jogger motor M rotates in such a direction as to cause the slide guide (R) 410 to move in the direction of the arrow L. Accordingly, the slide guide (R) 410 moves to cause reference pins (R) 430 thereof to abut on the right-side end part of the sheet S. Further, the slide guide (R) 410 moves in the direction of the arrow L so as to cause the left-side end surface of the sheet S to abut on reference pins (L) 431 of the fixed guide (L) 411.

Figure 7A:
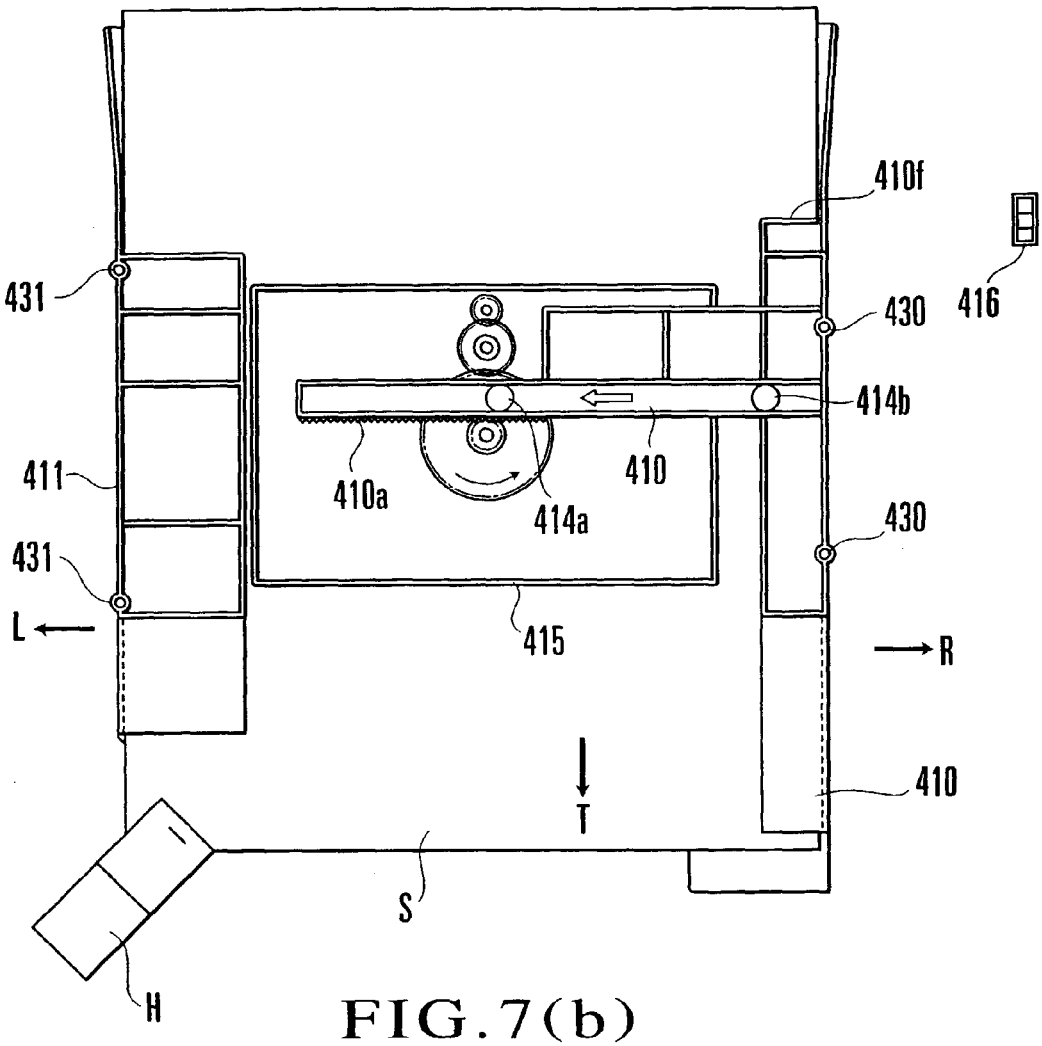
FIGS. 7(*a*) and 7(*b*) are sectional views for explaining the operation of the slide guide in the embodiment shown in FIGS. 6(*a*) and 6(*b*), showing the state in which sheets have been aligned by the slide guide and the fixed guide.
Figure 7B:
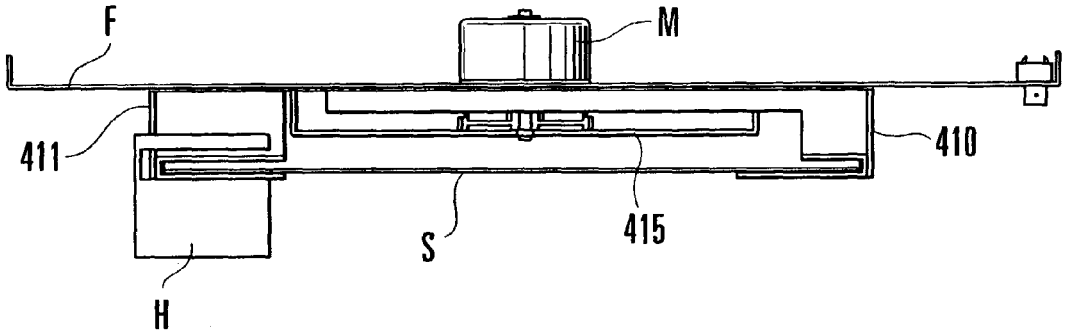

The state obtained after the alignment action has been performed is shown in FIGS. 7(*a*) and 7(*b*). In this instance, in consideration of any bending of the sheet S, etc., the slide guide (R) 410 may be moved up to a position where the interval between the reference pins (R) 430 and (L) 431 becomes narrower than the length of the sheet S in the width direction thereof.

The jogger motor M temporarily stops when there has been obtained the state shown in FIGS. 7(*a*) and 7(*b*). After that, the jogger motor M starts rotating reversely and then stops when the slide guide (R) 410 has come again to the standby position. The control action on the amount of movement of the slide guide (R) 410 is managed on the basis of the number of driving pulses for the jogger motor M, similarly to the first-mentioned embodiment.

A sheet for the second time or for the subsequent time is subjected to the alignment action in the similar manner. The above operation is performed until the last sheet Sn (for the n-th time) in one job is aligned. Then, in the state in which the reference pins (R) 430 and the reference pins (L) 431 provided on the slide guide (R) 410 and the fixed guide 411 abut on the right and left end parts of the sheet, the sheets are stapled by the stapling part H, which is located on the left side of the fore end of the sheet bundle.

According to the above-described construction and operation, during the alignment action on each sheet, the fixed guide (L) 411 is fixed to the reference position, and only the slide guide (R) 410 moves to cause the left-side end part of each sheet to align to the reference position for stapling. Accordingly, the stapling part H, which is fixedly disposed on the side of the fixed guide (L) 411, is enabled to perform the sheet stapling action surely and precisely.

Further, even in a case where sheets conveyed to the sheet processing apparatus 300 for one job vary in width, or even in a case where the sheet size varies from the size "LTR" to the size "A4" or the like, the left-side end part of each sheet is aligned to the constant position in respect of the width of each sheet. Therefore, the stapling part H is enabled to perform a stapling process excellent in accuracy.

In the present embodiment, when the stapling action is completed, the jogger motor M is driven to rotate, so that the slide guide (R) 410 moves in the direction of the arrow R from the state shown in FIG. 7(*a*). Then, when the end part of the supporting surface of the slide guide (R) 410 has moved in the direction of the arrow R beyond the position of the right-side end part of the sheet bundle as stapled, the sheet bundle drops downward as shown in FIGS. 8(*a*) and 8(*b*). Accordingly, the sheet bundle drops to the face-down discharge part (the second sheet stacking portion) 125, which is provided on the upper surface of the casing part 100A of the printer body 100, and is stacked there.

As described in the foregoing, the sheet processing apparatus according to the present embodiment is arranged such that, in addition to the advantageous effect of the first-mentioned embodiment, one of the guides is fixed. Therefore, it becomes possible to further the simplification and cost reduction of the sheet processing apparatus.

Incidentally, while the guide to be fixed is a guide disposed on the side where the stapling part H is located, the invention is not limited to this arrangement.

Next, a sheet processing apparatus according to a further embodiment of the invention will be described with reference to FIG. 9.

Figure 9:
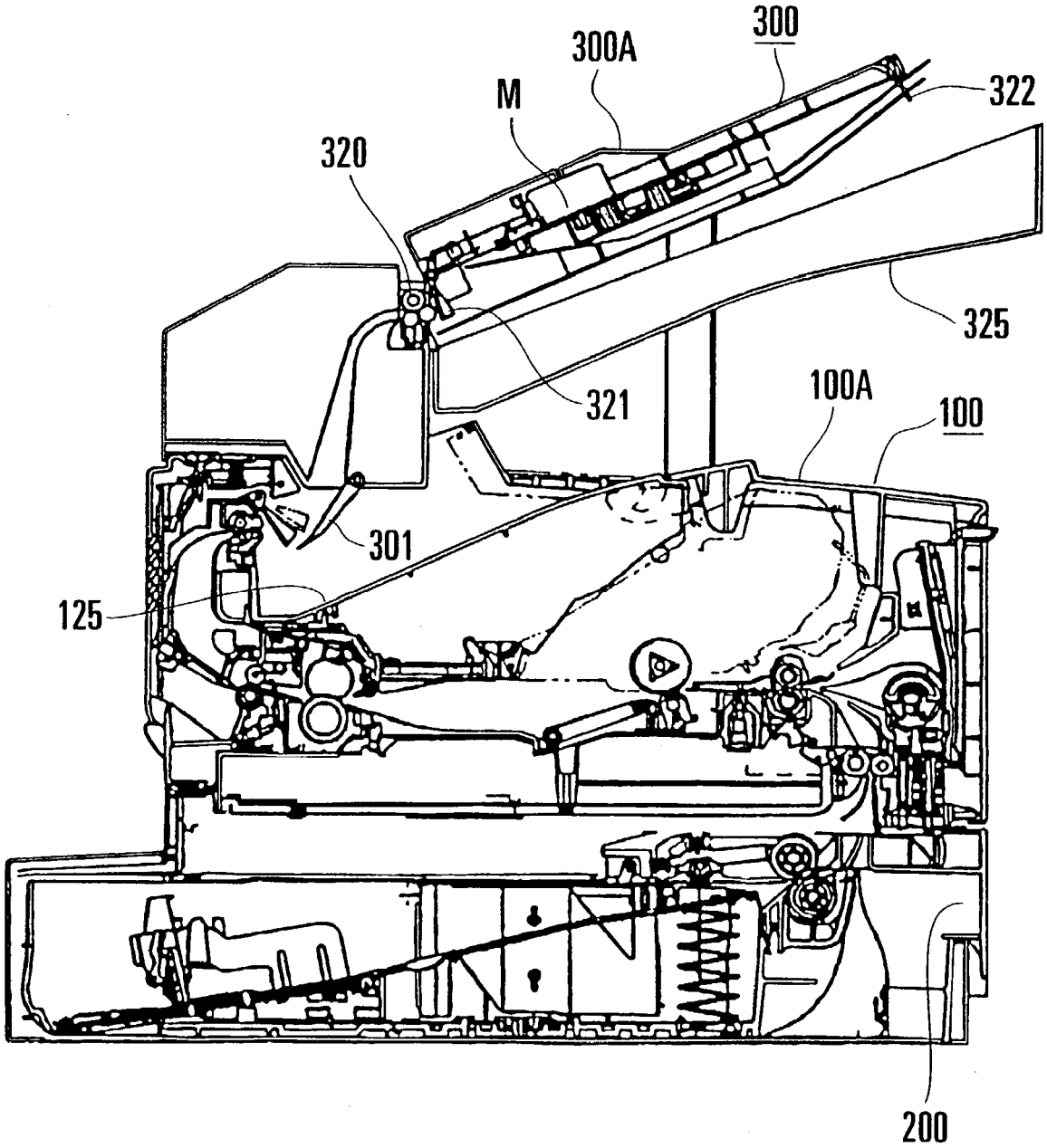
FIG. 9 is a sectional view showing in outline the arrangement of an image forming apparatus having a sheet processing apparatus mounted thereon according to a further embodiment of the invention.

In the sheet processing apparatus 300 shown in FIG. 9, a stacking tray 325 serving as a second sheet stacking portion for stacking thereon sheets discharged from the sheet processing apparatus 300 and sheet bundles subjected to the stapling process is disposed above the face-down discharge part 125 of the printer body 100.

In the present embodiment having such a construction, a sheet bundle subjected to the stapling process by the stapling part H is necessarily stacked on the stacking tray 325. Therefore, it becomes unnecessary to perform such a complicated control operation as described in the first-mentioned embodiment, i.e., a control operation for causing at least the next sheet after the sheet bundle subjected to the stapling process by the stapling part H is discharged to drop from the sheet processing apparatus 300, without discharging that sheet to the face-down discharge part 125 from the discharge roller 130 of the printer body 100.

Further, since it becomes possible to stack sheets or sheet bundles on the stacking tray 325 in addition to the face-down discharge part 125 of the printer body 100, the sheet processing apparatus 300 according to the present embodiment is very convenient for users to discharge a great number of sheets.

In addition, since, in the construction shown in FIG. 9, the stacking tray 325 is added to the sheet processing apparatus 300 and the printer body 100 shown in FIG. 1, the flapper 301, etc., are configured and controlled in the same manner as in the first-mentioned embodiment. However, if, instead of the construction in which the conveying path for a sheet having passed through the discharge roller 130 is changed over to the side of the sheet processing apparatus 300 or the face-down discharge part 125, the construction in which the conveying path for a sheet can be changed over before the sheet passes through the discharge roller 130 is adopted, the invention is advantageous even for the construction in which the second sheet stacking portion (the stacking tray) 325 is provided separately from the face-down discharge part 125.

Next, an operation for causing a sheet to drop, which is characteristic of the invention, will be described in detail with reference to FIG. 10 to FIGS. 13(*a*) and 13(*b*). FIG. 11(*a*) shows the sheet processing apparatus 300 as viewed from above, and FIG. 11(*b*) shows the section D—D of the sheet processing apparatus 300 shown in FIG. 11(*a*).

In the first-mentioned embodiment, a sheet bundle subjected to the stapling process by the stapling part H is made to drop by moving both the slide guides to their respective outsides of the sheet processing apparatus 300.

However, there are some cases where the sheet S sticks to the slide guide (R) 310 or (L) 311 due to static electricity caused by the alignment action on the slide guide 310 or 311 or due to a frictional state of the surface of the slide guide 310 or 311, so that a normal dropping operation of the sheet S is not performed. In view of such a case, the reference wall 323 is provided with a member for causing the sheet to drop correctly.

Figure 10:
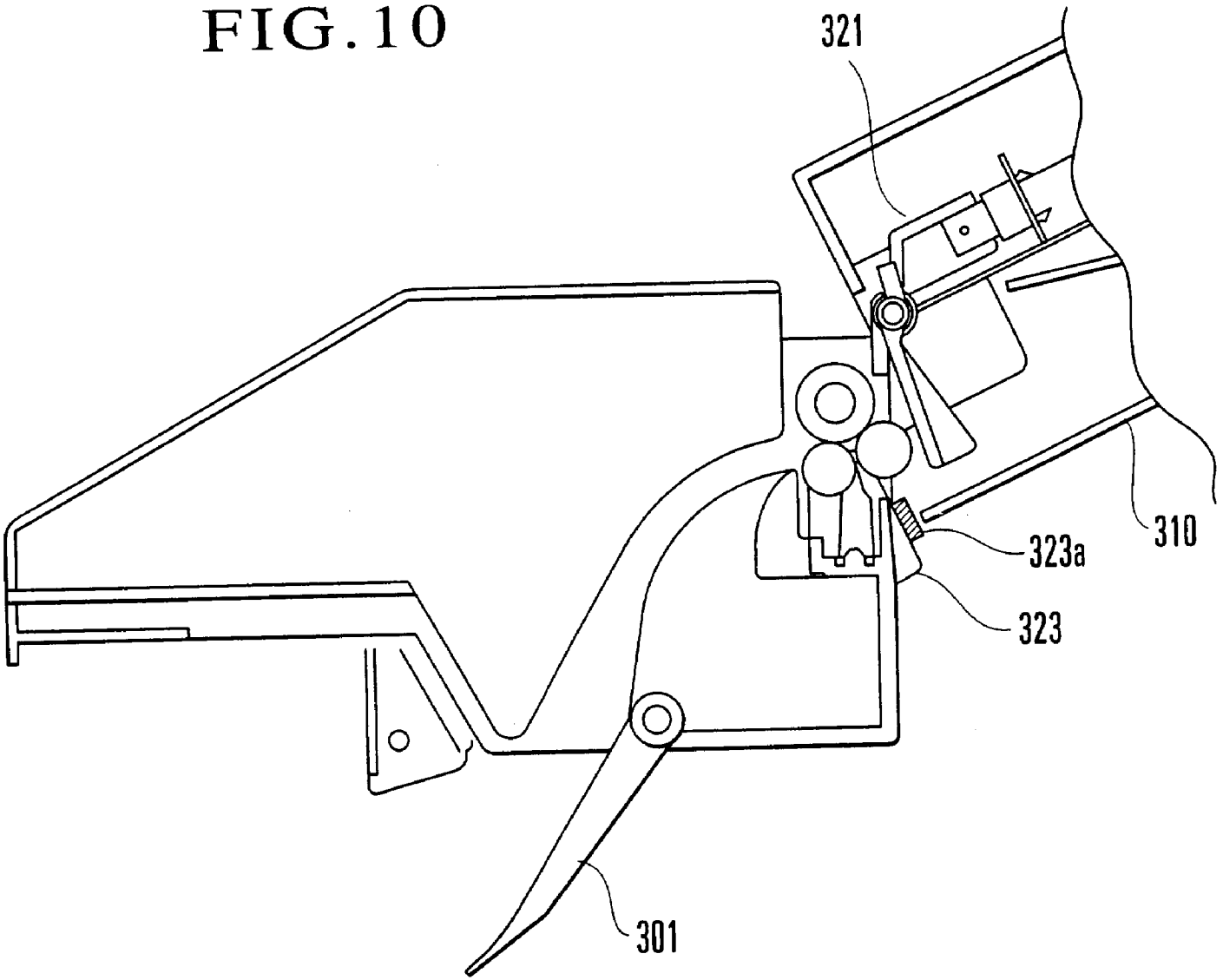
FIG. 10 is an enlargement view showing a reference wall and parts therearound.
Figure 11A:
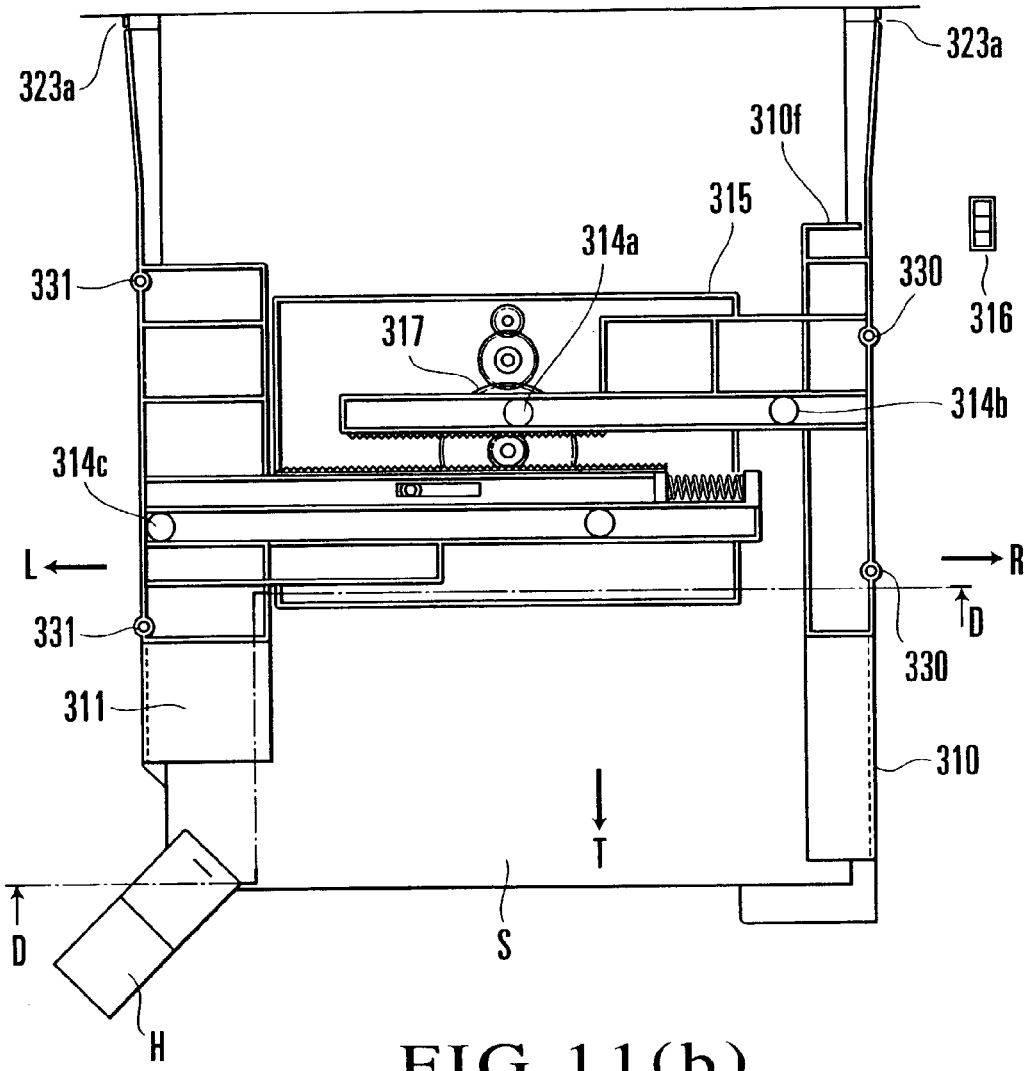
FIGS. 11(*a*) and 11(*b*) are sectional views for explaining the operation of a sheet processing apparatus in which side wall parts are provided at the reference wall, showing the state in which the slide guides are located at their standby positions.
Figure 11B:
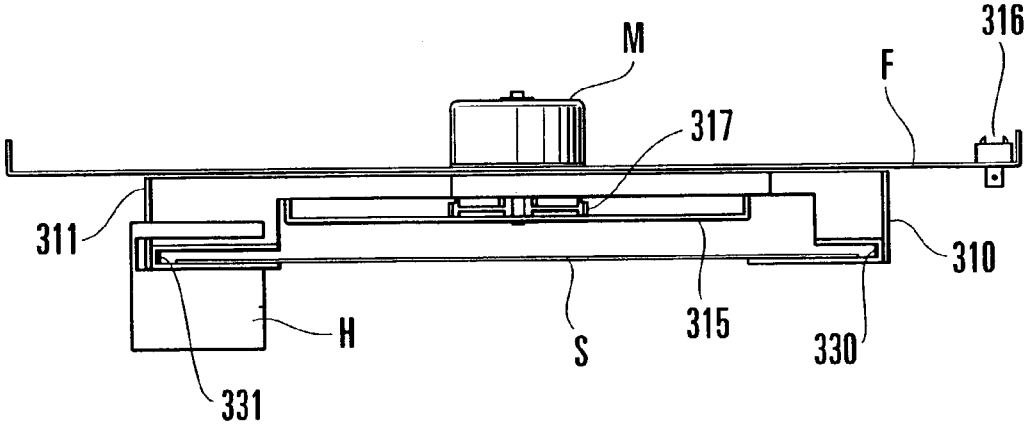
Figure 12A:
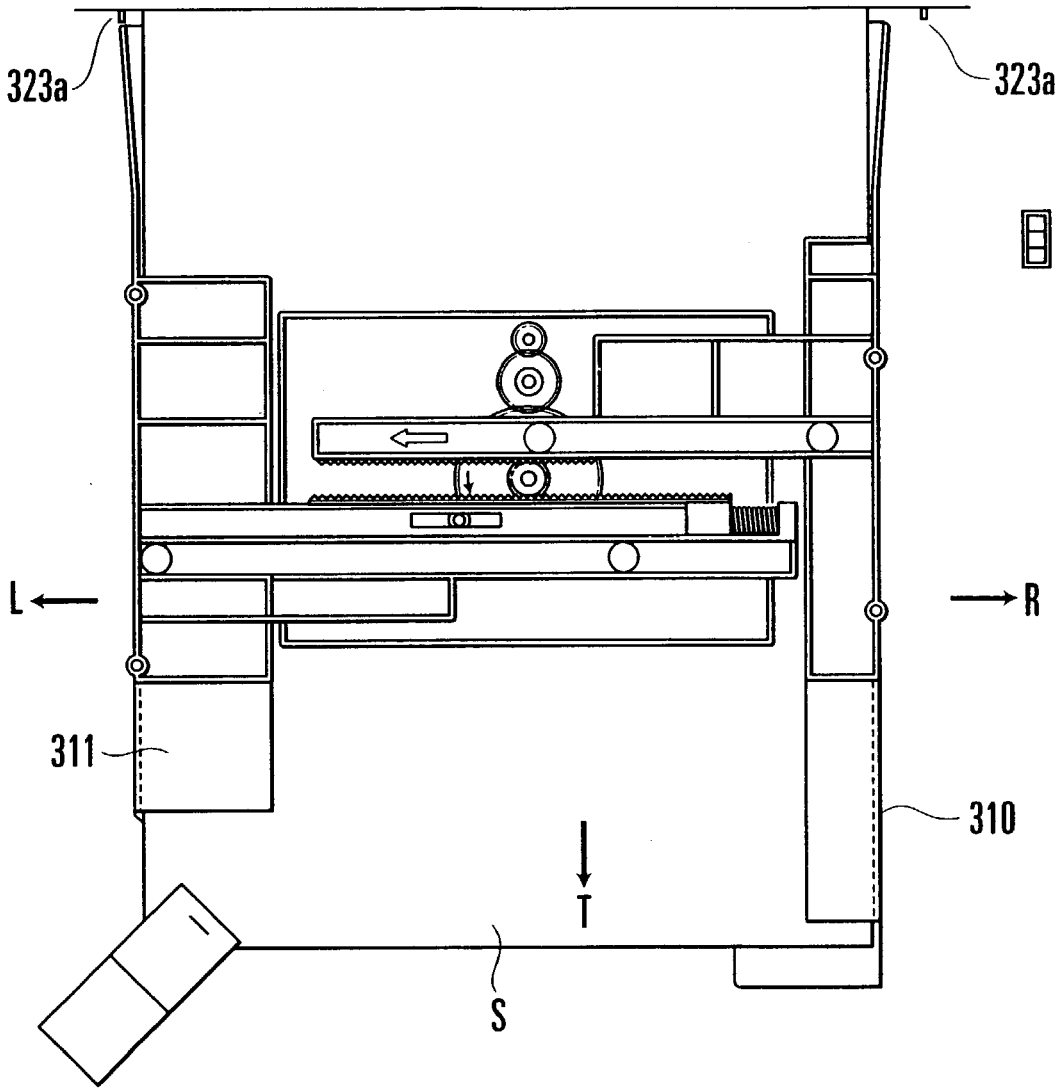
FIGS. 12(*a*) and 12(*b*) are sectional views for explaining the operation of the sheet processing apparatus in which the side wall parts are provided at the reference wall, showing the state in which sheets have been aligned by the slide guides.
Figure 12B:
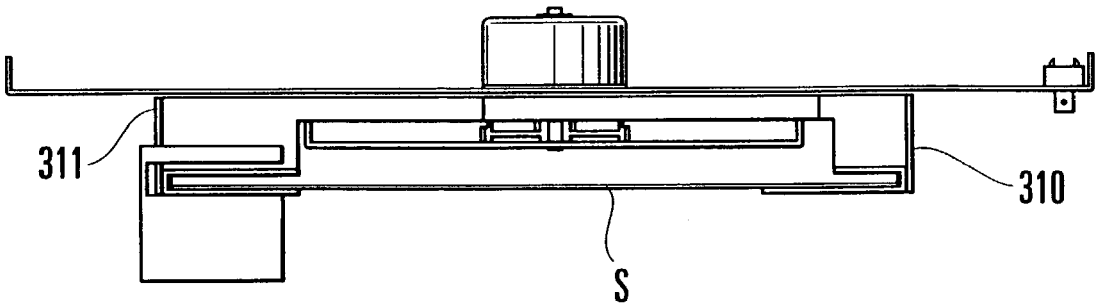

FIG. 10 is an enlarged sectional view showing parts around the reference wall 323 in the present embodiment. The reference wall 323 is provided with side wall parts 323*a*, which are projections indicated by hatching. As is understandable from FIG. 11(*a*), the side wall parts 323*a* are disposed in a protruded manner at the respective positions of the surface of the reference wall 323, which are separate from each other at an interval wider than the width of the sheet.

In the first-mentioned embodiment, there is the possibility that, even when the slide guides 310 and 311 are spread to the right and to the left, respectively, so as to cause a sheet stacked on the first sheet stacking portion 300B to drop, the sheet sticks to the slide guide 310 or 311, thereby deteriorating the property of dropping of the sheet, deteriorating the stacked state of the sheet after dropping, or, in some cases, causing jamming of the sheet.

Therefore, in order to cause the sheet to drop normally, the reference wall 323 is provided with the side wall part 323*a*. The advantageous effect of the side wall part 323*a* will be described below.

As mentioned in the foregoing, if, when the slide guides 310 and 311 are spread to the right and to the left, respectively, so as to cause the sheet to drop, the sheet sticks to any one of the slide guides 310 and 311, the sheet would follow the movement of the slide guide 310 or 311.

Figure 13A:
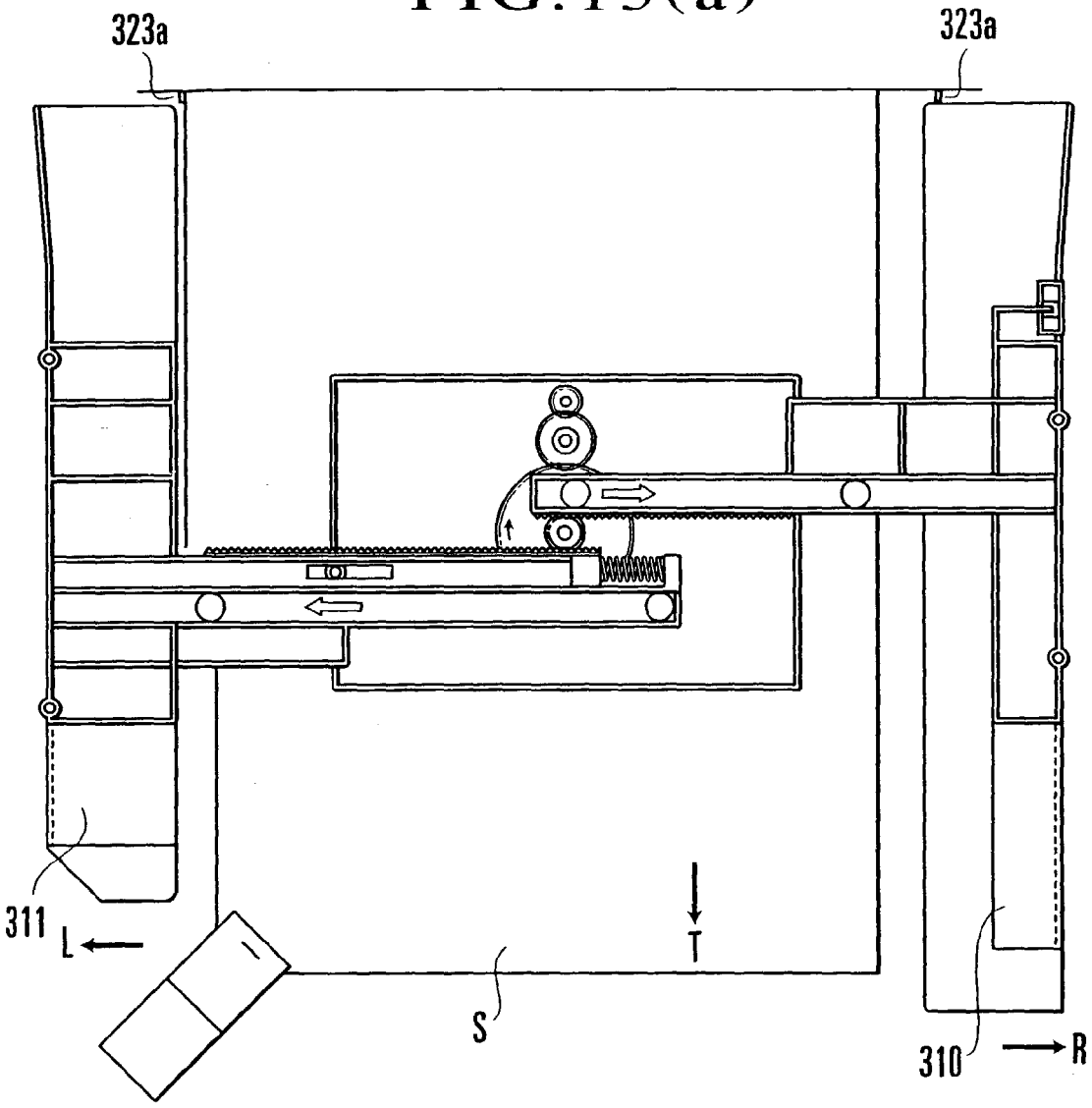
FIGS. 13(*a*) and 13(*b*) are sectional views for explaining the operation of the sheet processing apparatus in which the side wall parts are provided at the reference wall, showing the state in which the sheets abut on the side wall part and are then dropping.
Figure 13B:
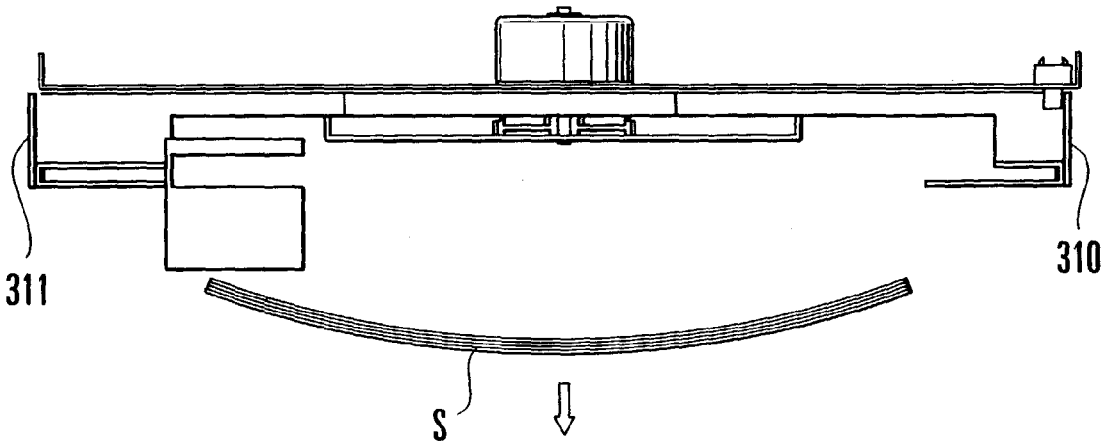

However, as shown in FIG. 13(*a*), the rear end part of the sheet which is in the state of sticking to the slide guide 311 abuts on the side wall part 323*a*, so that the sheet is prevented from following the movement of the slide guide 311. Accordingly, it becomes possible to cause the sheet to drop to the face-down discharge part 125 at an appropriate location. Since there is the possibility that the sheet sticks to either one of the slide guides 310 and 311, the side wall part 323*a* is provided on each side of the reference wall 323.

In addition, in a case where only one of the guide members is arranged to move as described with reference to FIG. 6(*a*), etc., the above-stated advantageous effect can be obtained if the side wall part 323*a* is provided only on the side of the guide member arranged to slide.

As has been described in the foregoing with the various embodiments, the invention enables the space saving and cost reduction to be realized with the more simplified construction than in the conventional sheet processing apparatus.

Incidentally, while the invention has been described on the basis of the embodiments in which the sheet processing apparatus 300 is disposed above a printer serving as the image forming apparatus, the sheet processing apparatus according to the invention may be mounted on any kind of apparatus, without limiting to the image forming apparatus, as long as it is arranged to perform a stapling process, a punching process, or the like, on the sheet.

Further, while the invention has been described on the basis of the construction in which one sheet processing apparatus 300 is provided, a plurality of sheet processing apparatuses may be provided in piles. For example, assuming that two sheet processing apparatuses are disposed one on top of the other, a sheet processed by the upper sheet processing apparatus is made to drop to the upper surface of the lower sheet processing apparatus. Therefore, it is preferable to provide the upper surface of the sheet processing apparatus with a stacking part for stacking sheets thereon. With a plurality of sheet processing apparatuses thus provided, it becomes possible to perform the various processes and to perform a process coping with a great number of jobs.

Further, the printer body 100 in each of the embodiments is assumed to be an apparatus of the so-called center reference type in which a sheet of any size is conveyed with the center of a conveying path taken as a reference. Therefore, a sheet which has been conveyed to the sheet processing apparatus 300 from the printer body 100 is discharged to the position where the center of the interval between the right and left guides is taken as a reference. However, even in a case where the printer body 100 is arranged to perform the so-called one-side reference conveying operation in which the sheet is conveyed with one side of the conveying path taken as a reference, it is of course possible to provide the sheet processing apparatus.

Further, the invention may be modified such that a sheet which has been conveyed to the sheet processing apparatus 300 is subjected to the alignment action and, after that, is made to drop to the face-down discharge part 125 on the upper surface of the printer body 100 without being subjected to any predetermined process.

The invention claimed is:

1. A sheet processing apparatus mountable on an upper surface of an image forming apparatus which forms an image on a sheet, comprising:

a first sheet stacking portion, which temporarily stacks sheets discharged from said image forming apparatus;

an alignment member, which supports and aligns the sheets discharged on said first sheet stacking portion, movable in a direction perpendicular to the sheet discharging direction;

a sheet processing unit which performs a predetermined process on the sheets stacked and aligned on said first sheet stacking portion; and a second sheet stacking portion which receives the sheets from said first sheet stacking portion, wherein said second sheet stacking portion is located substantially vertically below said first sheet stacking portion, wherein said alignment member drops the supported sheets to said second sheet stacking portion by movement of said alignment member in the direction apart from the supported sheets, and wherein the sheet processing apparatus is mounted on the upper surface of the image forming apparatus and is substantially within an area of installation of the image forming apparatus.

2. A sheet processing apparatus according to claim 1, wherein said first sheet stacking portion is composed of said alignment member.

3. A sheet processing apparatus according to claim 1, wherein said alignment member supports both end sides of the sheets in a width direction thereof, and does not support a middle portion of the sheets.

4. A sheet processing apparatus according to claim 1, wherein an angle which a support part of said first sheet stacking portion for supporting a fore end side, in a discharging direction, of the sheets discharged on said first sheet stacking portion makes with a horizontal plane is equal to or larger than an angle which a support part of said first sheet stacking portion for supporting a rear end side, in the discharging direction, of the sheets makes with the horizontal plane.

5. A sheet processing apparatus according to claim 1, wherein said first sheet stacking portion has a sheet return member arranged to abut on a fore end side, in a discharging direction, of the sheets discharged on said first sheet stacking portion so as to perform an alignment action on the sheets in the discharging direction.

6. A sheet processing apparatus according to claim 5, wherein said sheet return member has such an urging force as to return the sheets in a direction reverse to the discharging direction.

7. A sheet processing apparatus according to claim 5, wherein said sheet return member is arranged to return, with weight of said sheet return member, the sheets in a direction reverse to the discharging direction.

8. A sheet processing apparatus according to claim 5, wherein said first sheet stacking portion has a wall member arranged to abut on a rear end side, in the discharging direction, of the sheets discharged on said first sheet stacking portion, so as to align a rear end of the sheets returned to an upstream side in the discharging direction by said sheet return member.

9. A sheet processing apparatus according to claim 8, wherein said wall member is provided with projection parts which are disposed separate from each other at an interval larger than a width of the sheet and are arranged to abut on an end part of the sheets discharged on said first sheet stacking portion so as to drop the sheets to a predetermined position of said second sheet stacking portion.

10. A sheet processing apparatus according to claim 1, wherein said alignment member includes a guide member arranged to abut on a side surface of the sheets, in a width direction thereof, discharged on said first sheet stacking portion and to be movable in the width direction of the sheet, and driving unit which drives said alignment member.

11. A sheet processing apparatus according to claim 10, wherein said guide member is provided with a plurality of projections arranged to align the sheets to a prescribed position by abutting on the side surface of the sheet.

12. A sheet processing apparatus according to claim 11, wherein each of said plurality of projections is made of material of high abrasion resistance.

13. A sheet processing apparatus according to claim 10, wherein said guide member includes a pair of guide members disposed respectively on right and left sides in the width direction of the sheet, and wherein said pair of guide members are provided on said first sheet stacking portion in such a way as to be movable in the width direction of the sheet.

14. A sheet processing apparatus according to claim 10, wherein said guide member includes a pair of guide members disposed respectively on right and left sides in the width direction of the sheet, and wherein one of said pair of guide members is fixed to said first sheet stacking portion and the other of said pair of guide members is arranged to be movable in the width direction of the sheet.

15. A sheet processing apparatus according to claim 13, wherein said guide member is provided on said first sheet stacking portion and is restrained from moving in the width direction of the sheet by a guide pin arranged to guide the movement of said guide member.

16. A sheet processing apparatus according to claim 14, wherein said guide member is provided on said first sheet stacking portion and is restrained from moving in the width direction of the sheet by a guide pin arranged to guide the movement of said guide member.

17. A sheet processing apparatus according to claim 10, wherein said driving unit includes a motor arranged to generate a driving force, a transmission gear provided on said first sheet stacking portion and arranged to be rotated by the driving force, and a rack member provided on said guide member and arranged to change rotation of said transmission gear to a moving force in the width direction of the sheet.

18. A sheet processing apparatus according to claim 14, wherein, after a predetermined number of sheets are aligned by said pair of guide members, one or both of said pair of guide members move in such a direction as to widen the interval between said pair of guide members so as to cause the predetermined number of sheets, which have been stacked on said first sheet stacking portion, to drop to said second sheet stacking portion.

19. A sheet processing apparatus according to claim 1, wherein a plurality of sheet processing apparatuses each of which corresponds to said sheet processing apparatus are disposed vertically in piles, and an upper surface of a frame body of each of said plurality of sheet processing apparatuses is used as said second sheet stacking portion.

20. A sheet processing apparatus according to claim 1, further comprising change-over member which selectively changes over between said first sheet stacking portion and said second sheet stacking portion to which the sheet is to be conveyed.

21. A sheet processing apparatus according to claim 20, wherein said change-over member acts in such a way that after the sheets processed by said sheet processing unit is dropped on said second sheet stacking portion, the next sheet is discharged on said first sheet stacking portion.

22. A sheet processing apparatus according to claim 1, wherein said sheet processing unit is a stapler which staples a predetermined position of the sheets stacked on said first sheet stacking portion.

23. A sheet processing apparatus according to claim 22, wherein said stapler is disposed at an end part on a fore end side in a discharging direction of the sheet on said first sheet stacking portion.

24. A sheet processing apparatus mountable on an upper surface of an image forming apparatus which forms an image on a sheet, comprising:

a first sheet stacking portion which temporarily stacks the sheets discharged from said image forming apparatus;

an alignment member, which supports and aligns the sheets discharged on said first sheet stacking portion, movable in a direction perpendicular to the sheet discharging direction; and a sheet processing unit which performs a predetermined process on the sheets stacked and aligned on said first sheet stacking portion, wherein said alignment member drops the supported sheets to a second sheet stacking portion which is located below said first sheet stacking portion and provided on the upper surface of said image forming apparatus, by movement of said alignment member in the direction apart from the supported sheets, and wherein the sheet processing apparatus is mounted on the upper surface of the image forming apparatus and is substantially within an area of installation of the image forming apparatus.

25. A sheet processing apparatus according to claim 24, wherein said first sheet stacking portion is composed of said alignment member.

26. A sheet processing apparatus according to claim 24, wherein said alignment member supports both end sides of the sheets in a width direction thereof, and does not support a middle portion of the sheets.

27. A sheet processing apparatus according to claim 24, wherein said alignment member includes a guide member arranged to abut on a side surface of the sheets, in a width direction thereof, discharged on said first sheet stacking portion and to be movable in the width direction of the sheet, and driving unit which drives said alignment member.

* * * * *

UNITED STATES PATENT AND TRADEMARK OFFICE

CERTIFICATE OF CORRECTION

PATENT NO. : 7,216,863 B2
APPLICATION NO. : 10/420732
DATED : May 15, 2007
INVENTOR(S) : Takashi Kuwata et al.

It is certified that error appears in the above-identified patent and that said Letters Patent is hereby corrected as shown below:

ON THE TITLE PAGE:
At Item (56), References Cited, Foreign Patent Documents, "1151949 A1" should read --1 151 949 A1--., and "08225227 A" should read --08-225227 A--.

COLUMN 1:
Line 6, "Feb. 26, 2001now" should read -- Feb. 26, 2001, now--.

COLUMN 9:
Line 6, "when" should read --When--.

COLUMN 10:
Line 30, "tires" should read --tries--.

Signed and Sealed this

Eleventh Day of December, 2007

JON W. DUDAS
*Director of the United States Patent and Trademark Office*